US011832699B2

(12) United States Patent
Kim et al.

(10) Patent No.: US 11,832,699 B2
(45) **Date of Patent: *Dec. 5, 2023**

(54) DIFFUSER AND HAIR DRYER HAVING A DIFFUSER

(71) Applicant: LG ELECTRONICS INC., Seoul (KR)

(72) Inventors: Kyoungtae Kim, Seoul (KR); Hyunchul Kim, Seoul (KR); Yunhee Ku, Seoul (KR); Rayoung Park, Seoul (KR); Dongwon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 477 days.

This patent is subject to a terminal disclaimer.

(21) Appl. No.: 17/077,927

(22) Filed: Oct. 22, 2020

(65) Prior Publication Data

US 2021/0315355 A1 Oct. 14, 2021

(30) Foreign Application Priority Data

Apr. 10, 2020 (KR) ..... 10-2020-0044039

(51) Int. Cl.
*A45D 20/12* (2006.01)
*A46B 9/02* (2006.01)

(52) U.S. Cl.
CPC ..... *A45D 20/122* (2013.01); *A46B 9/023* (2013.01); *A45D 2020/128* (2013.01)

(58) Field of Classification Search
CPC . A45D 20/122; A45D 2020/128; A46B 9/023
USPC ..... 34/95–100
See application file for complete search history.

(56) References Cited

U.S. PATENT DOCUMENTS

| | | | | |
|---|---|---|---|---|
| 939,106 | A | 11/1909 | Soles | |
| 2,560,808 | A | 7/1951 | MacCallum | |
| 3,265,075 | A | 8/1966 | Edman | |
| 5,275,339 | A | 1/1994 | Andis et al. | |
| 5,568,691 | A * | 10/1996 | Rubin ..... | A45D 20/16 392/380 |

(Continued)

FOREIGN PATENT DOCUMENTS

| | | |
|---|---|---|
| CN | 1167430 | 12/1997 |
| CN | 203884936 | 10/2014 |

(Continued)

OTHER PUBLICATIONS

Taiwanese Notice of Allowance dated Jan. 5, 2022 issued in Application No. 109136741 (English translation attached).

(Continued)

*Primary Examiner* — Stephen M Gravini
(74) *Attorney, Agent, or Firm* — KED & ASSOCIATES

(57) ABSTRACT

The diffuser includes a diffusing case having a rear side removably coupled to a main body of a hair dryer. Fluid discharged from the main body is introduced into the diffusing case through an inlet hole defined at the rear side and discharged from a front side of the diffusing case. A light irradiator is provided inside the diffusing case to irradiate light toward the front side of the diffusing case, and a light diffusion frame is provided in front of the light irradiator. The light irradiated from the light irradiator is diffused while forwardly penetrating the light diffusion frame.

20 Claims, 12 Drawing Sheets

(56) References Cited

U.S. PATENT DOCUMENTS

| | | | | |
|---|---|---|---|---|
| 5,715,847 | A | 2/1998 | Rolf | |
| 6,070,597 | A | 6/2000 | Motherhead | |
| D477,112 | S | 7/2003 | Yeung | |
| 6,601,316 | B2 | 8/2003 | Shaw, II | |
| 7,040,037 | B2 | 5/2006 | Keong | |
| 7,380,347 | B2 * | 6/2008 | Coats | A45D 20/12 34/97 |
| 7,946,056 | B2 | 5/2011 | Kroll | |
| 8,387,271 | B2 * | 3/2013 | Shami | A45D 20/12 132/211 |
| 8,434,238 | B2 * | 5/2013 | Gross | A45D 20/12 132/212 |
| 8,720,078 | B1 | 5/2014 | Behbehani | |
| 9,144,286 | B2 | 9/2015 | Courtney | |
| 9,498,039 | B2 * | 11/2016 | Matsui | A45D 20/12 |
| 9,839,274 | B1 * | 12/2017 | Brickner | H02J 7/35 |
| 9,936,788 | B2 | 4/2018 | Stephens et al. | |
| 10,165,843 | B2 | 1/2019 | Hedges | |
| 10,238,199 | B2 | 3/2019 | Stephens | |
| 10,278,471 | B2 | 5/2019 | Shelton et al. | |
| 10,470,545 | B2 | 11/2019 | Thiebaut | |
| 10,610,001 | B2 | 4/2020 | Kim | |
| 10,660,418 | B2 | 5/2020 | deGrood et al. | |
| 10,702,037 | B2 | 7/2020 | Boateng | |
| 10,869,529 | B2 | 12/2020 | Chia | |
| 10,874,186 | B2 | 12/2020 | MacPherson | |
| D935,688 | S | 11/2021 | Park | |
| 11,253,040 | B2 * | 2/2022 | Kim | F21V 17/10 |
| 11,425,979 | B2 * | 8/2022 | Conrad | F24H 3/0423 |
| 11,457,713 | B2 * | 10/2022 | Conrad | A45D 20/10 |
| 11,464,313 | B2 * | 10/2022 | Wang | A45D 20/12 |
| 11,576,474 | B2 * | 2/2023 | Kim | A45D 20/122 |
| 11,633,028 | B2 | 4/2023 | Kim | |
| 2003/0079367 | A1 | 5/2003 | Troletti | |
| 2009/0000141 | A1 | 1/2009 | Gross et al. | |
| 2015/0007442 | A1 | 1/2015 | Gammack | |
| 2016/0367006 | A1 | 12/2016 | Stephens et al. | |
| 2016/0367008 | A1 | 12/2016 | Stephens et al. | |
| 2017/0105501 | A1 | 4/2017 | Palmer | |
| 2018/0036553 | A1 | 2/2018 | Shiibashi | |
| 2019/0014880 | A1 | 1/2019 | Degrood | |
| 2021/0315350 | A1 | 10/2021 | Kim | |
| 2021/0315351 | A1 * | 10/2021 | Kim | A45D 20/122 |
| 2021/0315353 | A1 | 10/2021 | Kim et al. | |
| 2021/0315354 | A1 | 10/2021 | Kim | |
| 2021/0315355 | A1 * | 10/2021 | Kim | A45D 20/122 |
| 2021/0315356 | A1 | 10/2021 | Kim | |
| 2022/0304444 | A1 | 9/2022 | Wang | |

FOREIGN PATENT DOCUMENTS

| | | |
|---|---|---|
| CN | 104273918 | 1/2015 |
| CN | 107529865 | 1/2018 |
| CN | 109247685 | 1/2019 |
| CN | 106539271 | 11/2019 |
| CN | 209732900 | 12/2019 |
| CN | 217013050 | 7/2022 |
| FR | 2766338 | 1/1999 |
| GB | 2612788 | 5/2023 |
| JP | 01-055803 | 4/1989 |
| JP | 2012-019865 | 2/2012 |
| JP | 2012-239535 | 12/2012 |
| JP | 2013-162830 | 8/2013 |
| JP | 2016-502432 | 1/2016 |
| JP | 2016-072174 | 5/2016 |
| JP | 2018-015539 | 2/2018 |
| JP | 6346700 | 6/2018 |
| JP | 2018-134441 | 8/2018 |
| JP | 2018-175726 | 11/2018 |
| JP | 3222699 | 8/2019 |
| KR | 20-1985-0002139 | 10/1985 |
| KR | 10-1997-0706745 | 12/1997 |
| KR | 20-1998-0026628 | 8/1998 |
| KR | 10-2001-0086200 | 9/2001 |
| KR | 10-2010-0066043 | 6/2010 |
| KR | 20-2011-0002484 | 3/2011 |
| KR | 10-1056026 | 8/2011 |
| KR | 10-1155135 | 6/2012 |
| KR | 20-0468263 | 8/2013 |
| KR | 20-2016-0002206 | 6/2016 |
| KR | 10-2016-0095646 | 8/2016 |
| KR | 10-2015-0023773 | 1/2017 |
| KR | 10-1758360 | 7/2017 |
| KR | 10-2017-0139520 | 12/2017 |
| KR | 10-2017-0138806 | 2/2018 |
| KR | 10-2018-0017193 | 2/2018 |
| KR | 10-1872227 | 6/2018 |
| KR | 20-2018-0003263 | 11/2018 |
| KR | 10-2018-0130756 | 12/2018 |
| KR | 10-1928531 | 12/2018 |
| KR | 10-2019-0072169 | 6/2019 |
| KR | 10-1988303 | 6/2019 |
| KR | 10-2019-0084801 | 7/2019 |
| KR | 10-2020-0033086 | 3/2020 |
| KR | 10-2020-0033115 | 3/2020 |
| TW | 201914475 | 4/2019 |
| TW | 201914476 | 4/2019 |
| TW | 201936080 | 9/2019 |
| WO | WO 2011/100711 | 8/2011 |
| WO | WO 2020/165554 | 8/2020 |
| WO | WO 2021/090155 | 5/2021 |

OTHER PUBLICATIONS

Taiwanese Notice of Allowance dated Oct. 18, 2021 issued in TW Application No. 109136744.

Korean Notice of Allowance dated Nov. 16, 2021 issued in KR Application No. 10-2020-0044040.

Korean Notice of Allowance dated Nov. 18, 2021 issued in KR Application No. 10-2020-0044038.

U.S. Office Action dated Jul. 20, 2022 issued in U.S. Appl. No. 17/077,929.

United States Office Action dated Apr. 25, 2022 issued in co-pending related U.S. Appl. No. 17/077,917.

United States Office Action dated Apr. 26, 2022 issued in co-pending related U.S. Appl. No. 17/077,921.

United States Notice of Allowance dated Oct. 12, 2022 issued in co-pending related U.S. Appl. No. 17/077,921.

International Search Report issued in Application No. PCT/KR2020/012282 dated Jul. 22, 2021.

International Search Report issued in Application No. PCT/KR2020/012288 dated Jul. 26, 2021.

Taiwanese Notice of Allowance dated Apr. 28, 2022 issued in Application No. 109137300 (English translation attached).

U.S. Appl. No. 17/077,917, filed Oct. 22, 2020.

U.S. Appl. No. 17/077,921, filed Oct. 22, 2020.

U.S. Appl. No. 17/077,922, filed Oct. 22, 2020.

U.S. Appl. No. 17/077,929, filed Oct. 22, 2020.

U.S. Appl. No. 17/085,385, filed Oct. 30, 2020.

U.S. Office Action dated Jul. 27, 2022 issued in U.S. Appl. No. 17/077,922.

U.S. Office Action dated Sep. 23, 2022 issued in U.S. Appl. No. 17/077,917.

International Search Report issued in Application No. PCT/KR2020/012272 dated Jul. 22, 2021.

International Search Report issued in Application No. PCT/KR2020/012273 dated Jul. 22, 2021.

International Search Report issued in Application No. PCT/KR2020/012284 dated Jul. 22, 2021.

International Search Report issued in Application No. PCT/KR2020/012286 dated Jul. 22, 2021.

International Search Report issued in Application No. PCT/KR2020/012292 dated Jul. 22, 2021.

International Search Report issued in Application No. PCT/KR2020/012289 dated Jul. 27, 2021.

Korean Office Action issued in Application No. 10-2020-0044041 dated Aug. 6, 2021.

(56) References Cited

OTHER PUBLICATIONS

Taiwan Office Action issued in Application No. 109137300 dated Aug. 13, 2021.
Taiwan Office Action issued in Application No. 109136742 dated Aug. 13, 2021.
Taiwan Office Action issued in Application No. 109136743 dated Aug. 13, 2021.
Taiwan Office Action issued in Application No. 109136745 dated Aug. 13, 2021.
U.S. Appl. No. 17/077,915, filed Oct. 22, 2020.
U.S. Appl. No. 17/077,927, filed Oct. 22, 2020.
U.S. Appl. No. 17/077,119, filed Oct. 22, 2020.
U.S. Office Action dated Aug. 31, 2023 issued in U.S. Appl. No. 17/077,119.

* cited by examiner

DIFFUSER AND HAIR DRYER HAVING A DIFFUSER

CROSS-REFERENCE TO RELATED APPLICATION

This application claims the benefit of Korean Patent Application No. 10-2020-0044039, filed on Apr. 10, 2020, which is hereby incorporated by reference as if fully set forth herein.

BACKGROUND

1. Field

The present disclosure relates to a diffuser and a hair dryer including a diffuser.

2. Background

When removing moisture from wet hair or when styling hair, a hair dryer that discharges gas through a gas outlet may be used.

In one example, the hair dryer may provide air or gas having certain characteristics desired by a user, such as a desired gas temperature, a desired gas speed, and a desired gas flow shape or area, through a diffuser. The diffuser may be coupled to a main body of the hair dryer to change the gas characteristics. Further, the diffuser may include a care device such as massage protrusions or bristles to manage scalp health and the like.

Korean Utility Model Application Publication No. 20-2011-0002484 discloses a diffuser provided in a hair dryer and having a massage protrusion that may perform user's scalp and hair care. The diffuser may include various components to manage or care for scalp and hair in addition to the massage protrusion. Therefore, it is an important task in the technical field to provide effective means for the management and care of the user's scalp or hair.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
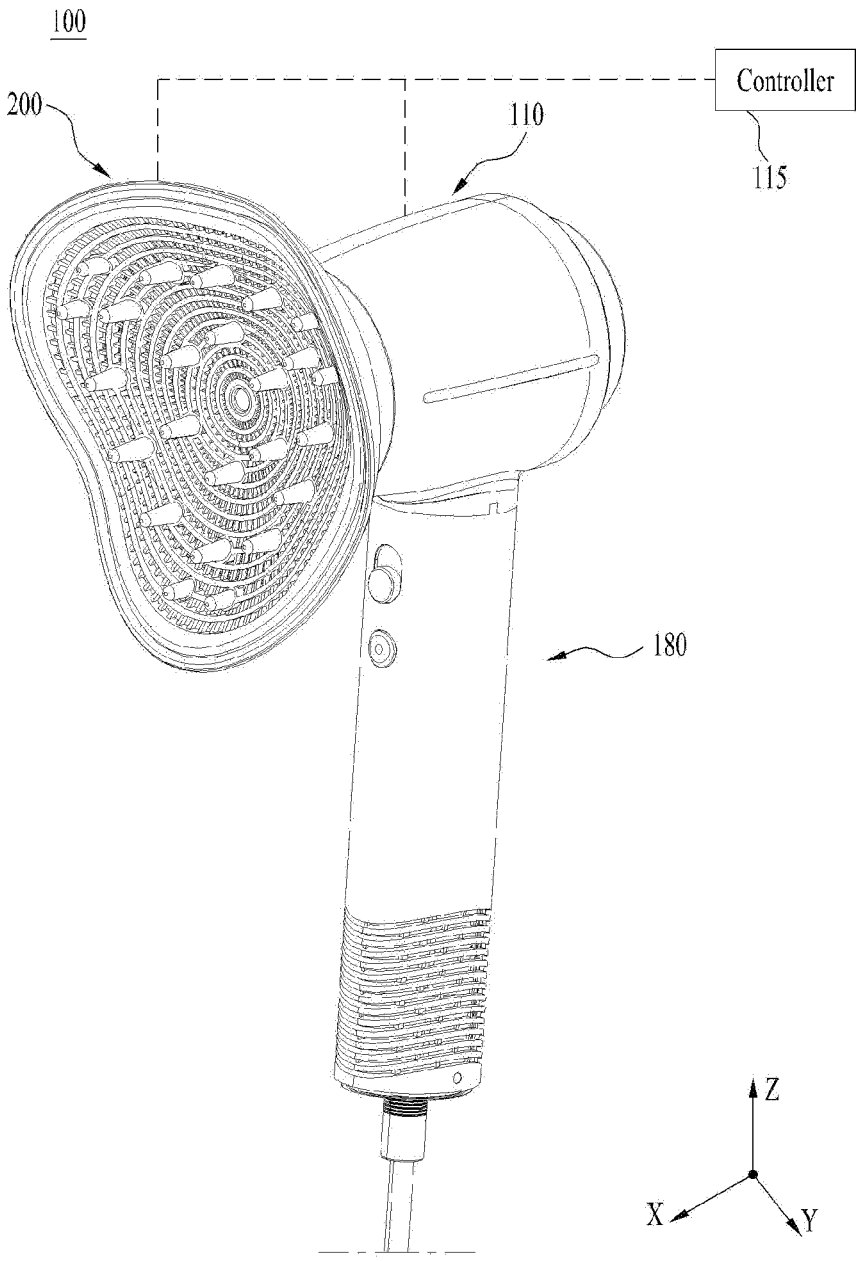
FIG. 1 is a view showing a hair dryer according to an embodiment.
Figure 2:
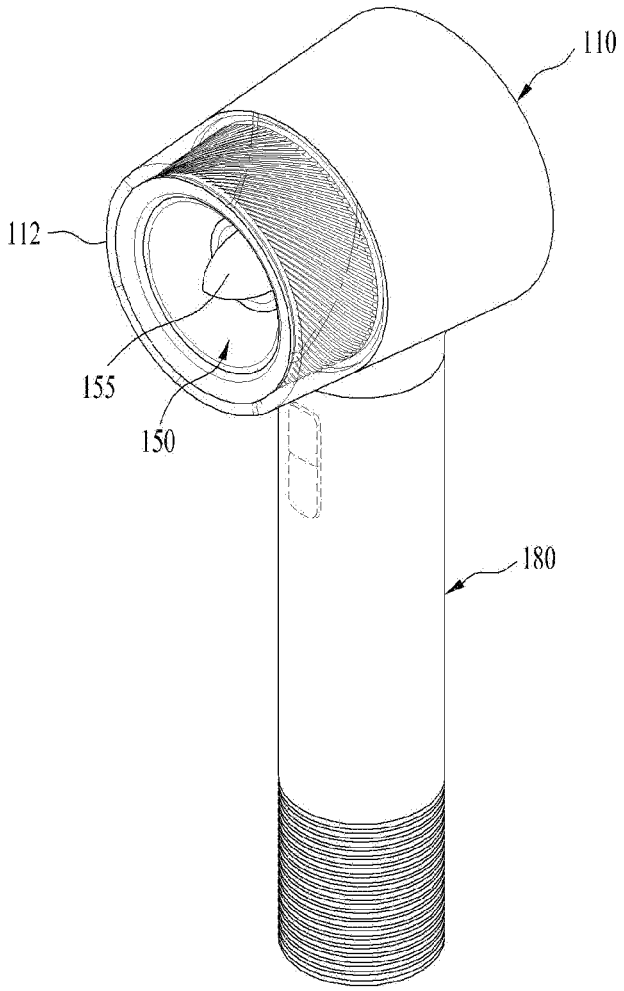
FIG. 2 is a view showing a state in which a diffuser is separated from the hair dryer shown in FIG. 1.
Figure 3:
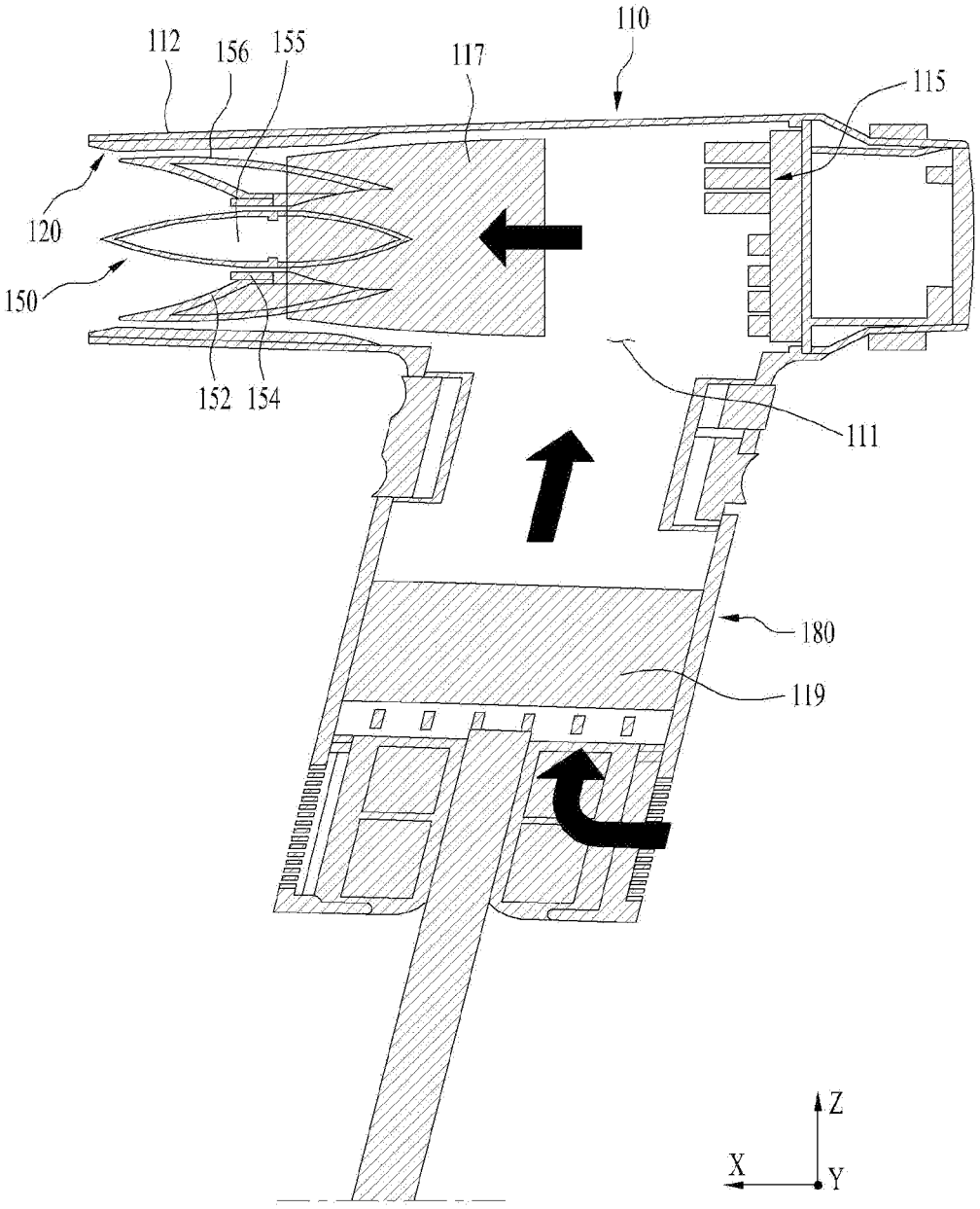
FIG. 3 is a view showing an internal cross-section of the hair dryer shown in FIG. 2.

Referring to FIGS. 1-3, a hair dryer 100 may include a main body 110, a handle 180, and a diffuser 200 as shown in FIG. 1. In addition, as shown in FIG. 2, the main body 110 may include a gas or air outlet 150 through which gas or air introduced from outside is discharged.

As shown in FIG. 3, the main body 110 may include a gas or air flow path 111 through which the introduced gas flows. The gas inside of the gas flow path 111 may be discharged through the gas outlet 150 to the outside. The main body 110 may have an extended shape along a front-rear direction and may have various cross-sectional shapes such as circular, elliptical, stadium, or polygonal shapes when viewed from the front.

In the present disclosure, front, rear, left, right, top, and bottom definitions may be made centering on the main body 110. Referring to FIG. 2, the gas outlet 150 may be provided at a front side of the main body 110, and the handle 180 may have a shape extending substantially downward from the main body 110.

The gas flowing inside the main body 110 may be introduced through a gas inlet, which may be provided on the handle 180 (as shown in FIG. 3) or alternatively on the main body 110 (for example, at a rear of the main body 110). As shown in FIGS. 1 to 3, when the gas inlet is provided on the handle 180, the gas flow path 111 may extend from gas inlet formed in the handle 180 toward the gas outlet 150 of the main body 110, or upward and frontward. The gas may be introduced or suctioned from the outside through the gas inlet, and the introduced gas may flow along the gas flow path 111 and be discharged to the outside through the gas outlet 150.

The handle 180 may be a portion of the hair dryer 100 grabbed by a hand of a user, and may have a shape that improves grip convenience. The handle 180 may extend downward from the main body 110, as illustrated in FIGS. 1 to 3, but embodiments disclosed herein are not limited to a downward handle 180. The handle 180 may be integrally molded with the main body 110, or separately manufactured from the main body 110 and later coupled to the main body 110.

When the handle 180 is manufactured separately from the main body 110 and later coupled to the main body 110, the handle 180 may be provided such that a longitudinal direction thereof with respect to the main body 110 is fixed or variable. For example, the handle 180 may have a hinge coupling portion or hinge structure, and may be coupled to the main body 110 such that the longitudinal direction of the handle 180 is changeable (e.g., foldable) relative to the main body 110 so as to make grasping and/or styling convenient.

The extending direction of the handle 180 may vary. However, for convenience of description below, the direction in which the handle 180 extends from the main body 110 will be described as a downward direction.

Referring to FIG. 3, the hair dryer 100 according to an embodiment may include a fan 119 capable of moving (e.g., suctioning and/or discharging) gas or air and adjusting a speed of the gas or air discharged through the gas outlet 150.

The fan 119 may be provided in the gas flow path 111 to blow the gas. The fan 119 may be provided inside the handle 180 (as illustrated) or alternatively inside of the main body 110 (e.g., a rear of the main body 110).

The fan 119 may be provided near or adjacent to the gas inlet. For example, when the gas inlet is provided in the handle 180, the gas flow path 111 may extend from the gas inlet of the handle 180 to the gas outlet 150, and the fan 119 may be provided in a portion of the gas flow path 111 located in the handle 180.

A temperature adjuster 117 (e.g., a heater or cooler) may be provided inside of the main body 110 (or alternatively, the handle 180) to adjust a temperature of the discharged gas. The temperature adjuster 117 may be provided in various forms and may be provided at various positions. In FIG. 2, the temperature adjuster 117 is provided inside the main body 110.

In addition, the temperature adjuster 117 may be provided in various types. The temperature adjuster 117 may use a heating scheme by providing current to a coil-shaped resistor to generate heat. However, the resistor of the temperature adjuster 117 may not necessarily be in the shape of the coil, and may be provided in various types, such as a thermoelement capable of heating the gas or adjusting the temperature of the gas. As another example, the temperature adjuster 117 may include a thermoelectric cooler (TEC) or Peltier device to provide cool air.

A method for operating the hair dryer 100 according to an embodiment of the present disclosure will be schematically described with respect to gas or air flow.

First, the user may manipulate or operate a power button provided on the main body 110 or the handle 180. When the power button is turned on, the fan 119 may be operated, and gas may be introduced or suctioned into the hair dryer 100.

The gas introduced through the gas inlet flows along the gas flow path 111 via the fan 119 toward the gas outlet 150, and the gas is discharged through the gas outlet 150 to the user. In this process, a flow speed of the gas along the gas flow path 111 may be adjusted by the fan 119, and a temperature of the gas flowing along the gas flow path 111 may be adjusted by the temperature adjuster 117.

In one example, the hair dryer 100 according to an embodiment may include a controller 115. The controller 115 may be connected not only to the fan 119, the temperature adjuster 117, the power button, and a manipulator or user interface to select a desired temperature or flow speed, but also to a light irradiator or light 260 (FIG. 6), a proximity sensor 269 (FIG. 6), a moisture measurement protrusion or sensor 312 (FIG. 6), and the like, which may be provided on the diffuser 200 and to be described later. The controller 115 may control the above described components.

The controller 115 may be provided on one of the diffuser 200, the main body 110, or the handle 180. Alternatively, a plurality of controllers 115 may be respectively arranged on all of the diffuser 200, the main body 110, and the handle 180. As indicated in FIG. 3, the controller 115 may be provided on the main body 110 to be signally connected to the diffuser 200, or, as indicated by the dotted lines in FIG. 1, a plurality of controllers 115 may be respectively arranged on the diffuser 200 and the main body 110.

Figure 6:
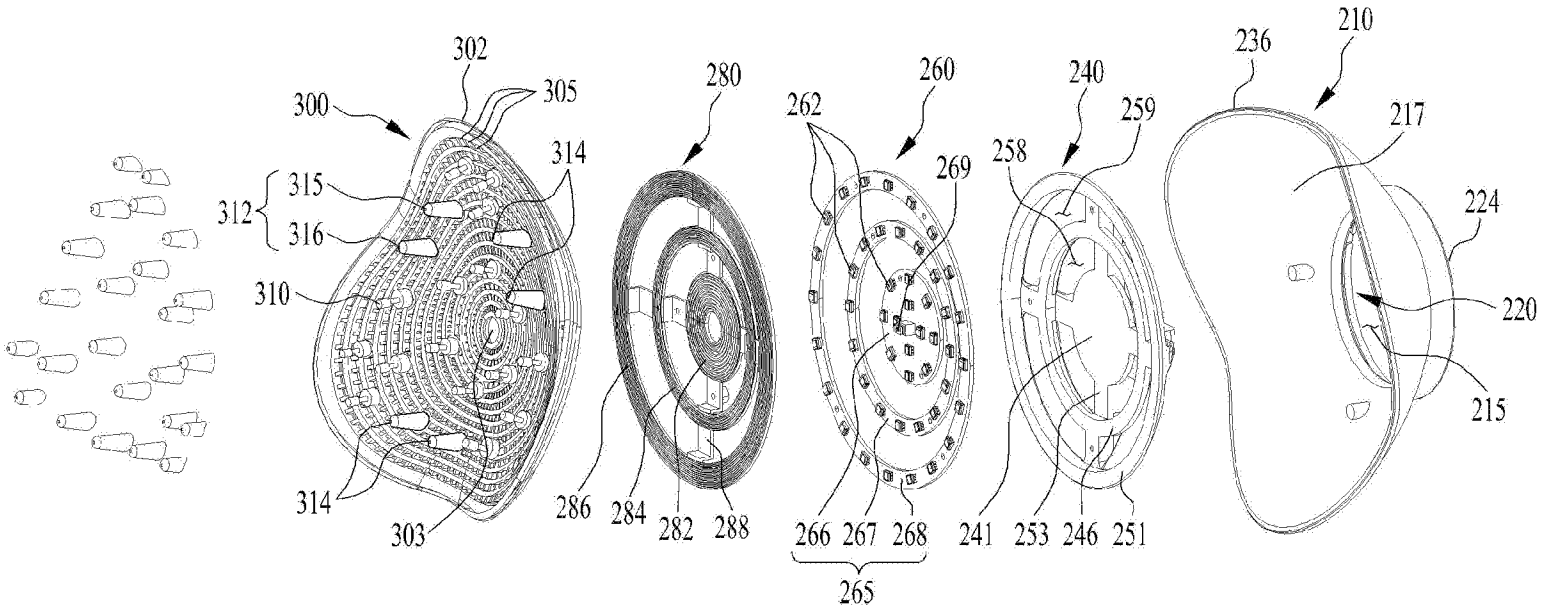
FIG. 6 is a view showing an exploded view of a diffuser according to an embodiment.

Adjusting operating states of the fan 119 and the temperature adjuster 117 may be performed by manipulation of the manipulator or user interface by the user or may be automatically performed based on an operation mode preset or predetermined in the controller 115. In addition, when a distance to a target located in front of the diffuser 200 is identified to be equal to or less than a reference or predetermined distance through the proximity sensor 269 of the diffuser 200, the controller 115 may control the light irradiator 260 of the diffuser 200 to irradiate light (FIG. 6).

The controller 115 may identify an impedance of the target located in front of the diffuser 200 through the moisture measurement protrusion 312 of the diffuser 200, and determine a moisture amount of the target through the impedance. As the moisture amount increases, the controller 115 may control the fan 119 such that the speed of the gas discharged through the gas outlet 150 increases, control the temperature adjuster 117 such that the gas temperature increases, or control the light irradiator 260 such that a light amount of the light irradiator 260 increases.

As shown in FIG. 1 or 3, the main body 110, where the gas outlet 150 is provided, may have a cross-section in an approximately circular shape and may have a front-rear length that is longer than a left-right width or diameter of the cross-section. However, the cross-section shape of the main body 110 may be varied as needed.

Figure 4:
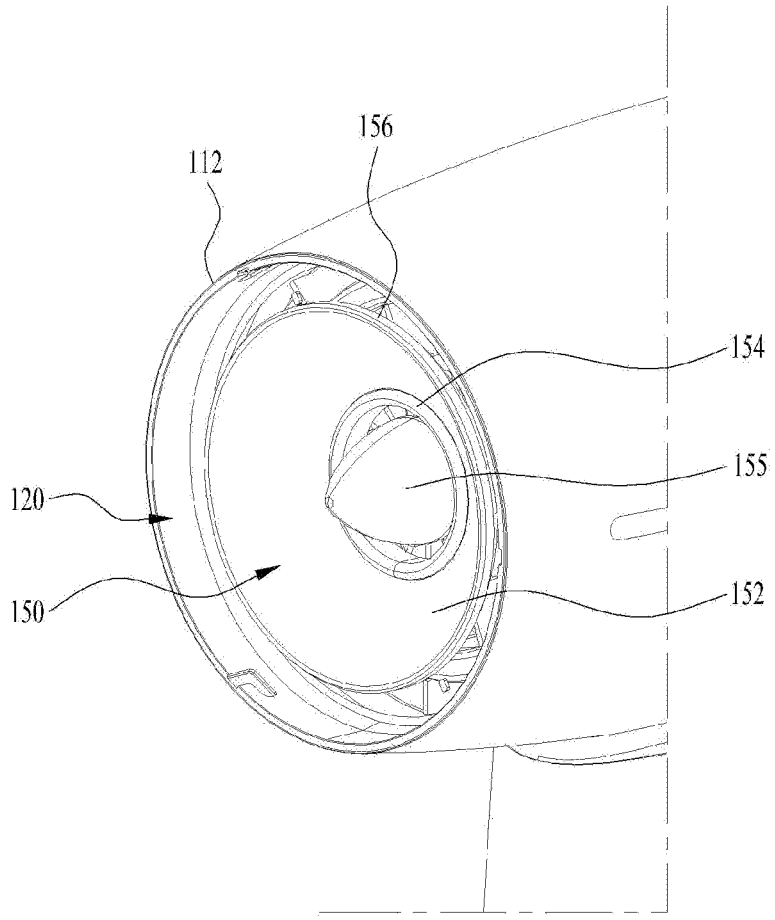
FIG. 4 is a view showing a gas outlet of a hair dryer according to an embodiment.

The gas outlet 150 of the hair dryer 100 according to an embodiment of the present disclosure will be described in detail with reference to FIG. 3. At least a portion of the gas flow path 111 may be defined inside the main body 110, and at least one side of the main body 110 may be opened or have an opening. For example, the main body 110 may extend in the front and rear direction, and a front surface thereof may be opened at a front end 112 (FIG. 4). The front end 112 may be a wall or front rim defining a front opening. The front opening of the main body 110 may be in communication with the gas flow path 111. The gas outlet 150 may be defined by an inner rim or surface of the front end 112. The front opening of the main body 110 may correspond to an end of the gas flow path 111, and the end of the gas flow path 111 may correspond to the gas outlet 150.

Referring to FIG. 4, in one example, the gas outlet 150 may include a discharge base or disc 152, which may be provided at the front opening of the main body 110. The discharge base 152 may be concentric with or provided inside of the front end 112. An outer edge of the discharge base 152 may be spaced apart from the front end 112 to define a side portion or opening 156 therebetween. The discharge base may have a center portion or opening 154. Gas may be discharged through the side and center openings 154 and 156, which may alternatively be referred to as outer and inner openings. The gas flowing along the gas flow path 111 may be simultaneously delivered to the center opening 154 and the side opening 156 to be discharged to the outside.

The center opening 154 and the side opening 156 may correspond to discharge holes through which the gas is discharged from the gas outlet 150. The center opening 154 may be defined at a central side on the cross-section of the gas outlet 150, and a cross-sectional shape thereof may be circular. However, embodiments disclosed herein are not limited to circular cross-sections, and a shape of the center opening 154 may be a polygonal shape such as a square as needed, and a size of a diameter, width, or cross-sectional area thereof may also be varied as needed.

The side opening 156 may surround the center opening 154. For example, as shown in FIG. 4, the center opening 154 may be defined in a substantially circular shape at the center of the discharge base 152 and/or a center of the entire gas outlet 150, and the side opening 156 may be an opening in a shape of a ring surrounding the discharge base 152. The ring shape may have an extended shape and/or a closed curve shape. For example, FIG. 4 discloses the side opening 156 having a circular ring shape. However, the ring shape of the side opening 156 may not necessarily be circular, and may be, for example, a polygonal ring shape such as a triangle or a square.

An optional guide cone 155 may be provided inside of the center opening 154 such that gas flows through a ring-shaped opening defined between, on the one hand, an inner side of the discharge base 152 defining the center opening 154, and, on the other hand, an outer surface of the guide cone 155. Details of the discharge base 152 and guide cone 155 will be described later. Like the shape of the side opening 156, the shape of the portion of the center opening 154 outside of the guide cone 155 is not limited to a circular ring shape, and may be, for example, a polygonal ring shape such as a triangle or a square.

The center opening 154 and the side opening 156 may be in communication with a same portion of the gas flow path 111. The center opening 154 may be concentric with the side opening 156.

A cross-sectional area of the entirety of the discharged gas may correspond to a size of an entire cross-section formed by the front end 112. However, The discharge base 152 may block a portion of the gas flowing through the gas outlet 150. The discharged gas may be diffused while flowing through the side opening 156, and a portion of the gas flow may be distributed toward a center of the cross-section where the gas is not discharged (i.e., toward the discharge base 152), and thus, the cross-sectional area of the discharge gas may be reduced.

The center opening 154 may be defined at a center of the side opening 156, and the gas of the side opening 156 that is distributed toward the center of the discharge base 152 may be suppressed by gas discharged through the center opening 154. he gas flowing through the center opening 154 may suppress the gas flowing through the side opening 156 and prevent the gas flowing through the side opening 156 from being distributed toward the center of the gas outlet 150. An entirety of the discharged gas may maintain an initial cross-sectional area thereof.

Gas flowing through the center and side openings 54 and 156 may have a large cross-sectional area, facilitating a drying process. For example, an entire volume of gas discharged through the center opening 154 and the side opening 156 may be sufficient to allow the user to dry a larger area.

Since the center opening 154 and the side opening 156 may be in communication with the same cross-sectional area of the gas flow path 111, there may not necessarily be separate gas flow paths 111 for the center opening 154 and the side opening 156. Thus, provided three-dimensional gas discharge to the user may be efficient.

The center opening 154 may be defined at a center of the discharge base 152, and the side opening 156 may be defined between an outer circumferential surface of the discharge base 152 and the front end 112 of the main body 110, which may be a wall or rim defining the front opening.

The discharge base 152 may be coupled to the front end 112 of the main body 110 and may have a same cross-sectional shape of the front opening, but embodiments disclosed herein are not be limited thereto and may be formed in various shapes or materials. For example, the discharge base 152 may be provided to be partially different from the shape of the front opening of the main body 110 to determine the shape of the side opening 156, and may be molded with a material that is the same as or different from a material of the front end 112 or outer wall of the main body 110.

The discharge base 152 may constitute an entirety or a portion of one surface (e.g., the front surface) of the main body 11, so that the center opening 154 may be defined at the center of the discharge base 152, and the side opening 156 may be defined between the outer circumferential surface of the discharge base 152 and the front end 112 of the main body 110.

The discharge base 152 may be coupled to an opening of the main body 110 in various schemes, such as a scheme using a plurality of coupling ribs and/or may be integrally molded with the main body 110.

In one example, as shown in FIG. 4, the discharge base 152 may be indented or recessed toward an interior of the main body 110 from the front end 112 such that a front rim of the front end 112 protrudes further forward than a front surface of the discharge base 152.

Furthermore, a center of the front surface of the discharge base 152 may be indented or recessed toward the interior of the main body 110 such that the front surface of the discharge base 152 may form a curved or bent surface. Accordingly, the gas discharged through the center opening 154 may be discharged upstream or before the gas discharged through the side opening 156.

When the gas discharged through the center opening 154 starts to be diffused prior to the gas discharged through the side opening 156, the cross-sectional area of the gas discharged through the central opening 154 may be increased through diffusion, and may suppress a flow of the gas discharged through the side opening 156 toward a center. Further, a curvature of the curved surface of the front surface of the discharge base 152 may be variously set as necessary to prevent or reduce turbulence.

A guide cone 155 may be provided at a center of the center opening 154 to guide a flow of the gas discharged through the center opening 154. The gas may be discharged between an inner surface of the center opening 154 and the guide cone 155.

FIG. 4 illustrates the guide cone 155 provided at the center of the center opening 154. As the guide cone 155 is provided, the gas flowing through the center opening 154 is discharged into a space between the inner surface of the center opening 154 and an outer surface of the guide cone 155.

When the guide cone 155 is provided at the center of the center opening 154, the gas may flow through an outer portion of the center opening 154, which may be a ring-shaped discharge hole. The gas discharged through the center opening 154 may have a ring-shaped cross-section.

The gas discharged through the center opening 154 may contribute to suppressing a reduction of a cross-sectional area of the gas discharged through the side opening 156 by blocking some gas discharged through the side opening 156 from flowing toward inward toward a center in the flow process. In addition, the guide cone 155 may increase a level or speed at which the gas discharged through the center opening 154 diffuses outward.

When the cross-sectional area of the gas discharged through the center opening 154 is increased due to the guide cone 155, the suppression of inward flow of gas discharged through the side opening 156 may be increased.

In one example, in the guide cone 155, a rear end protruding toward the gas flow path 111 and a front end protruding in a discharge direction of the gas of the center opening 154 may respectively have conical shapes. The conical shape may mean a shape in which a cross-sectional area has a circular or elliptical shape, and where a diameter or width of the circle gradually decreases as a length increases.

However, in the conical shape, the circular shape of the cross-sectional area is not limited to perfect circles and may have, for example an ellipse or stadium shape. Furthermore, a reduction in the diameter may not necessarily be constant; for example, a diameter reduction rate may gradually increase or gradually decrease.

As the front end of the guide cone 155 protrudes in the conical shape, the gas discharged through the center opening 154 may be increasingly concentrated toward a rim of the center opening 154. Thus, a flow of the gas discharged through the side opening 156 and flowing toward the center opening 154 may be further suppressed.

An outer circumferential surface of the guide cone 155 may have a shape or size corresponding to an inner circumferential surface of the center opening 154, and a separation distance between the outer circumferential surface of the guide cone 155 and the inner circumferential surface of the center opening 154 may be varied as needed. Further, the guide cone 155 may be made of a material the same as or different from the material of the discharge base 152, and a curvature of the outer surface thereof may be variously designed as needed.

In one example, the gas outlet 150 may further include a discharge guide ring. The discharge guide ring may be provided on the inner surface of the center opening 154 and protrude in the discharge direction of the gas discharged through the center opening 154 to guide the gas flow together with the guide cone 155. FIG. 4 illustrates that the guide cone 155 and the discharge guide ring may be arranged in the center opening 154.

The discharge guide ring may have a ring shape extending along the rim of the center opening 154, and may be integrally molded with the discharge base 152 or molded separately from the discharge base 152 to be later coupled to the inner circumferential surface of the center opening 154.

The discharge guide ring may protrude outward or forward and rearward from the center opening 154 or the discharge base 152 and/or protrude based on the gas discharge direction. The flow of the gas through the center opening 154 may be concentrated between the guide cone 155 and the discharge guide ring by the guide cone 155 and the discharge guide ring protruding from the center opening 154. A protruding end of the discharge guide ring may have a curved shape to facilitate the gas flow. A diameter of the discharge guide ring may be different for each portion, and a shape thereof may also be varied as needed. The front end 112 of the main body 110 may include a first coupling member 120 described later.

Figure 5:
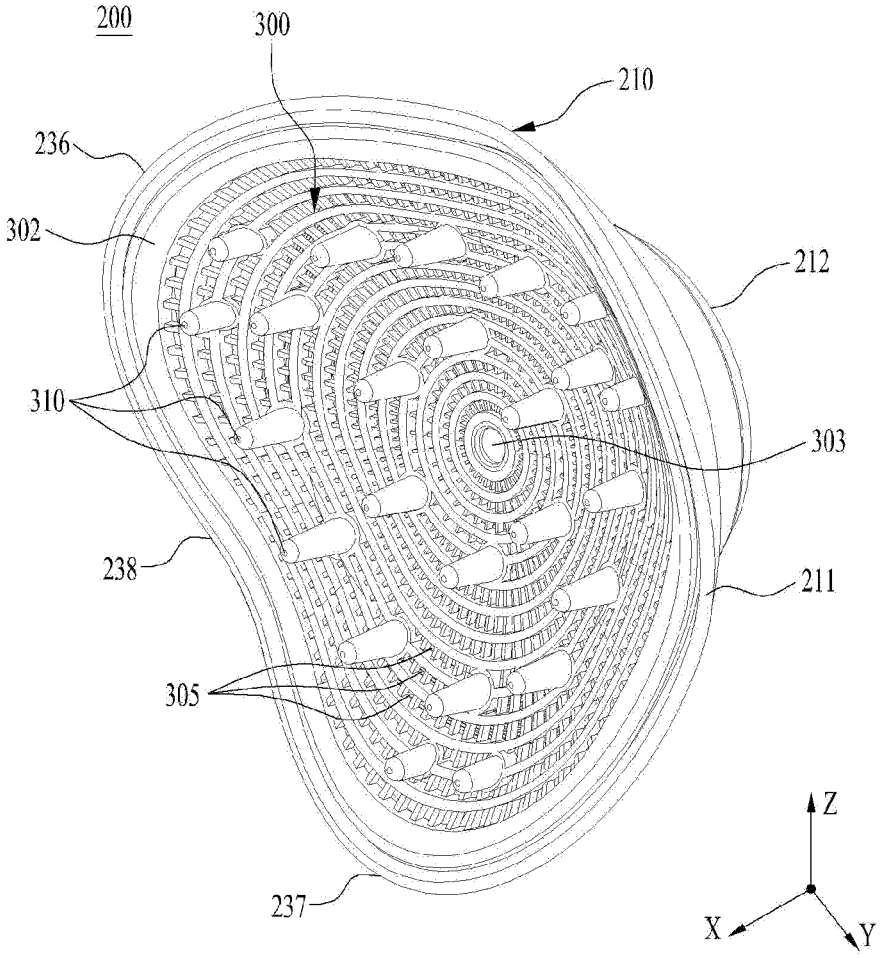
FIG. 5 is a view showing a diffuser according to an embodiment.

Referring to FIGS. 5 and 6, the diffuser 200 may be removably coupled to the main body 110 so that the gas discharged from the gas outlet 150 may be introduced into the diffuser 200 and to be discharged to the outside of the hair dryer 100. The diffuser 200 may alternatively be referred to as a head or nozzle head.

The diffuser 200 may be coupled to the main body 110 such that a rear side thereof covers the gas outlet 150, and the gas discharged from the gas outlet 150 may flow into the diffuser 200 through a gas inlet hole 215 defined at a rear side of the diffuser 200.

The user may selectively use the diffuser 200 for scalp or hair management. For example, the user may use a diffuser 200 including a massage protrusion or bristle 310 and a light irradiator or light 260, which will be described later, for scalp care. The user may also use the same diffuser 200 to dry hair, and a shape of the diffuser 200 may be configured such that a flow of a cross-sectional area of the gas is increased as needed in a hair drying step.

The rear side of the diffuser 200 may be coupled to the front end 112 of the main body 110. A first coupling portion or member 120 (FIG. 4) may be provided at the front end 112 of the main body 110, and a second coupling portion or member 220 configured to be coupled to the first coupling portion 120 may be provided at the rear side of the diffuser 200.

A coupling scheme between the diffuser 200 and the main body 110 may vary. The diffuser 200 may be coupled to the main body 110 in a scheme such as screw coupling, fitting coupling, magnetic coupling, or sliding coupling to receive the gas from the main body 110.

An embodiment of the present disclosure may improve ease of use of the user as the diffuser 200 is provided to be removable from the main body 110. For example, the user may remove the diffuser 200 when the user desires to use more concentrated gas discharged directly from the gas outlet 150 of the main body 110. Further, the user may add the diffuser 200 to the main body 110 when the user wants a more diffused or dispersed flow of gas.

The diffuser 200 may include a diffusing case 210 and a discharge or diffuser cover 300. The diffusing case 210 and a discharge cover 300 may form an exterior of the diffuser 200.

The diffuser may have a curved bell shape or hat shape. An inner diameter of the diffuser 200 may increase in a forward direction. An internal cross-sectional area of the diffusing case 210 and discharge cover 300 increases from a rear side or end 212 to a front side or rim 211.

Accordingly, gas delivered from the gas outlet 150 may be provided to the user in a state in which a flow cross-sectional area thereof is increased as the gas speed is reduced in the forward direction of the diffuser 200. The user may use the diffuser 200 for natural drying, styling, etc. for hair.

The front side 211 of the diffusing case 210 may be opened to define an open front surface. An entirety or a portion of the front surface of the diffusing case 210 may define the open surface. The gas present inside the diffuser 200 may be discharged to the outside through the open surface of the diffusing case 210 and be provided to the user while being discharged forward through the front side 211.

The open surface defined at the front side 211 of the diffusing case 210 may be exposed to the outside, or the discharge cover 300 may be provided to be coupled to the open surface.

FIG. 5 shows a state in which the discharge cover 300 is coupled to the open surface. The discharge cover 300 may include at least one gas discharge hole 305 defined therein through which the gas may be discharged. The discharge cover 300 may have a shape corresponding to the open surface of the diffusing case 210 and may be coupled to the diffusing case 210 to be located on or at the open surface.

A plurality of gas discharge holes 305 may be defined and may be spaced apart from each other in the front surface of the discharge cover 300. FIG. 5 shows a plurality of gas discharge holes 305 that are uniformly distributed and arranged in the front surface of the discharge cover 300. In such an arrangement, gas may be discharged through an entirety of the front surface of the discharge cover 300, and the user may receive gas that is discharged forward through the discharge cover 300 and more uniformly dispersed.

The discharge cover 300 may be provided such that an edge 302 located on the outermost side with respect to a radial direction of the diffuser 200 is in close contact with the diffusing case 210. The diffusing case 210 may have a front circumferential portion or rim 236 surrounding the open surface in the front side 211, and the edge 302 may have a shape corresponding to that of the front circumferential portion 236 and may be in contact with the front circumferential portion 236.

The front circumferential portion 236 may have a first portion 237 and a second portion 238. The first portion 237 and the second portion 238 may be arranged with different distances from the gas inlet hole 215 and/or rear side 212 of the diffusing case 210. The first and second portions 237 and 238 may represent various curves or waves defined by an outer edge of the diffusing case 210. The first portion 237 may be a hump or mountain and the second portion 238 may be a valley such the front circumferential portion 236 is further forward at the first portion 237 than at the second portion 238. The edge 302 of the discharge cover 300 may be molded to correspond to shapes of the first portion 237 and the second portion 238 so as to be in close contact with the front circumferential portion 236 of the diffusing case 210.

The front circumferential portion 236 of the diffusing case 210 and the edge 302 of the discharge cover 300 may be designed to fit over or on a head of the user with an arbitrary curved surface while respectively having curvatures and having different lengths protruding forward along an outer circumferential direction of the diffuser 200. Accordingly, a proximity or molding with the scalp or the hair of the user may be efficiently increased to minimize a space between the head of the user and the diffuser 200, thereby increasing a heating, drying, or treating effect. An amount of gas discharged forward through the discharge cover 300 and/or an amount or intensity of light provided by the light irradiator 260 may be efficiently increased.

An ergonomic design is made through the front circumferential portion 236 of the diffusing case 210 and the edge 302 of the discharge cover 300, which may be arranged to form curves when viewed from the side as described above and shown in the figures. In this case, the curvatures and the like of the front circumferential portion 236 and the edge 302 may be designed based on a standard head that is statistically determined.

For example, an embodiment of the present disclosure may define a R127 curvature design from a shape of the standard head, and design the shapes of the front circumferential portion 236 and the edge 302, and an overall shape of the diffusing case 210 and discharge cover 300, to correspond thereto.

In one example, a proximity or distance sensor 269 may be provided inside the diffusing case 210 to improve ease of use and efficiency of the diffuser 200. An open region or hole 303 may be defined in the discharge cover 300 such that a distance measurement accuracy of the proximity sensor 269 for a target in front of the diffuser 200 (e.g., the hair or the scalp of the user) may be improved. The proximity sensor 269 may be implemented in various schemes such as pressure, ultrasound, infrared, laser, light, etc. to measure a distance to the target in front of the proximity sensor 269, and a region of the discharge cover 300 in front of the proximity sensor 269 may be opened to define the open region 303.

In one example, FIG. 5 shows a discharge cover 300 having a plurality of massage protrusions or bristles 310. The massage protrusions 310 may have a pillar shape protruding forward from the diffuser 200 and may press the scalp of the user to provide a massage effect. A cross-sectional shape, a protruding length, an arrangement form, and the like of the massage protrusions 310 may be variously determined in terms of a design. An embodiment of the present disclosure provides the user with scalp massage through the massage protrusions 310 while also providing the gas diffused through a front surface of the discharge cover 300 to the user, thereby providing the improved ease of use and facilitating scalp and hair care.

Figure 7:
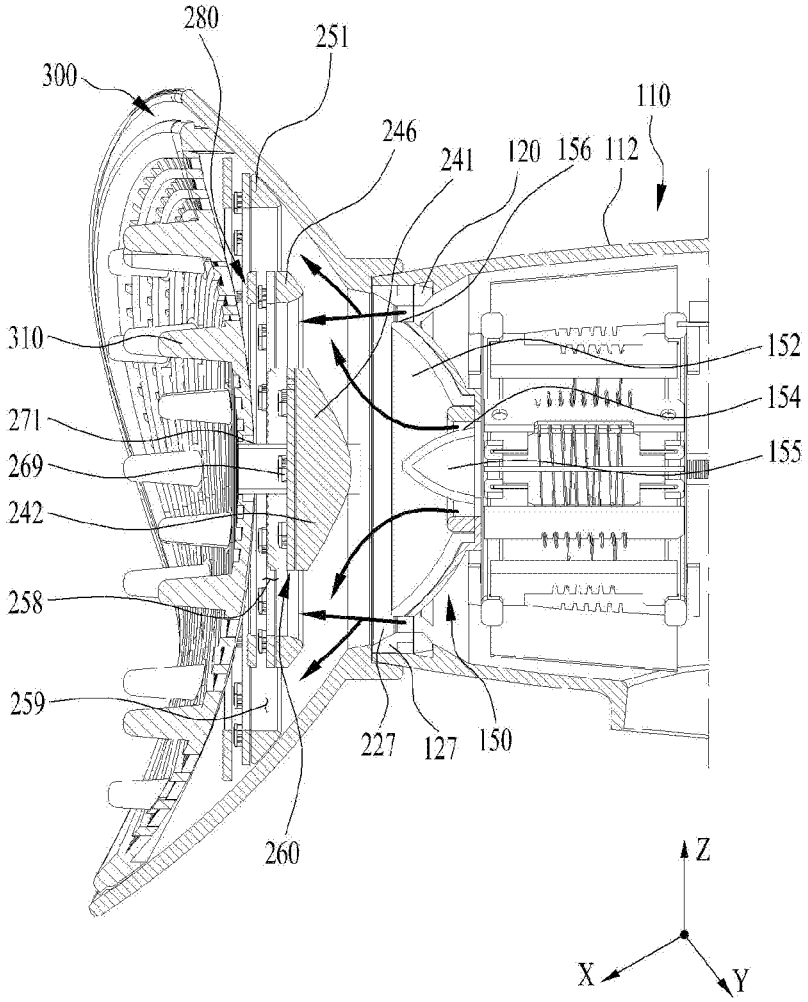
FIG. 7 is a view showing an internal cross-section of a diffuser according to an embodiment.

Referring to FIGS. 6 and 7, the diffuser 200 may include the diffusing case 210, a guide frame 240, the light irradiator 260, a light diffusion frame 280, and the discharge cover 300.

A rear side 212 of the diffusing case 210 may be coupled with the main body 110, and the open surface may be defined in the front side 211. The inner diameter of the diffusing case 210 may increase from the rear side 212 to the front side 211 so that the gas exiting the main body 110 may be diffused and discharged to the outside. The gas discharged through the gas outlet 150 of the main body 110 may be provided to the user in a state in which the flow cross-sectional area thereof is increased as the gas is flowing in the diffusing case 210.

FIGS. 6 and 7 show a diffusing case 210 in which the inner diameter thereof increases from the rear side 212 to the front side 211 and accordingly an outer diameter thereof increases in the same manner. The gas inlet hole 215 may be defined in the rear side 212 of the diffusing case 210. When the diffusing case 210 is coupled to the main body 110, the gas inlet hole 215 may be positioned to face, surround, or communicate with the gas outlet 150. Further, the gas discharged from the gas outlet 150 may be introduced into the diffusing case 210 through the gas inlet hole 215.

The gas inlet hole 215 may be located at a center of the rear side 212 of the diffusing case 210 when viewed from the rear, and a cross-sectional shape of the gas inlet hole 215 may correspond to that of the gas outlet 150. For example, the gas inlet hole 215 may be defined to have an inner diameter larger than that of the side opening 156 of the gas outlet 150, so that the gas discharged from the gas outlet 150 may be completely introduced into the diffusing case 210 through the gas inlet hole 215.

The second coupling portion 220 coupled to the main body 110 may be provided on the rear side 212 of the diffusing case 210. The diffusing case 210 may include a rear circumferential portion or body 217 surrounding the gas inlet hole 215 in the rear side 212, and the second coupling portion 220 may be provided at a rear end or side of the rear circumferential portion 217 surrounding the gas inlet hole 215.

The second coupling portion 220 may further include a coupling sleeve or flange 224. The coupling sleeve 224 may extend rearward from the rear of the rear circumferential portion 217. The coupling sleeve 224 may be provided to outwardly surround the front end 112 of the main body 110 when the diffuser 200 is coupled to the main body 110.

The first coupling portion 120 may be provided at the front end 112 of the main body 110 and may have a first magnetic fastening portion 127 (e.g., a magnet of a first polarity or a metal) embedded inside the outer wall of the front end 112 or located inside the outer wall. The first coupling portion 120 may further include a power transmitter or transceiver (e.g., a wireless power transceiver that works through electromagnetic induction) provided on an outer surface or a front surface of the outer wall of the front end 112.

The second coupling portion 220 may have a second magnetic fastening portion 227 (e.g., a magnet of a second polarity or a metal) embedded in the rear circumferential portion 217 or located inside the rear circumferential portion 217. The second coupling portion 220 may further include a power receiver or transceiver (e.g., a wireless power transceiver that works through electromagnetic induction) provided on or at an inner surface or rear surface of the coupling sleeve 224.

The first coupling portion 120 may be coupled to the second coupling portion 220. At least one of the first magnetic fastening portion 127 and the second magnetic fastening portion 227 may include a magnetic force generator (e.g., a ferromagnetic material or an electric current) so that the first magnetic fastening portion 127 and the second magnetic fastening portion 227 may be magnetically coupled to each other. The magnetic coupling means a scheme of mutual coupling through a magnetic force generated from the magnetic force generator, which may be implemented as a magnet and/or an electromagnet.

The power transmitter may supply power to the power receiver, which may be aligned, in contact with, or in connection with the power receiver when the diffuser 200 is coupled to the main body 110. The power receiver may be connected to components or devices of the diffuser 200 (e.g., the light irradiator 260, the proximity sensor 269, and the moisture measurement protrusion 312 described later) to supply power thereto.

The open surface surrounded by the front circumferential portion 236 may be defined in the front side 211 of the diffusing case 210, and the gas inside the diffusing case 210 may be discharged forward through the diffuser 200 through the open surface in the front side 211.

The guide frame 240 may be provided inside the diffusing case 210. The guide frame 240 may guide the flow of the gas introduced through the gas inlet hole 215.

The guide frame 240 may face the gas inlet hole 215 of the diffusing case 210. The guide frame 240 may have a diffusion portion or base 241 at a center thereof, a first guide or ring 246 provided radially outward of the diffusion portion 241, and a second guide or ring 251 provided radially outward of the first guide 246. The guide frame 240 may include a guide connector or tab 253 extending along the radial direction of the diffuser 200 to connect the diffusion portion 241, the first guide 246, and the second guide 251 to each other.

The diffusion portion 241 of the guide frame 240 may face the gas inlet hole 215 to diffuse the gas introduced through the gas inlet hole 215 outward in the radial direction. The flow cross-sectional area of the gas introduced through the gas inlet hole 215 may be increased by the diffusion portion 241.

A flow direction of the gas discharged from the center opening 154 may be changed by the diffusion portion 241. The diffusion portion 241 may have a larger diameter than the center opening 154, and diffuse the gas provided from the center opening 154 outward in the radial direction.

The first guide 246 may have a ring shape, and the diffusion portion 241 may be located at a center of the first guide 246. The diffusion portion 241 may have a circular cross-section, and may be outwardly spaced apart from the diffusion portion 241 while being concentric with the diffusion portion 241 of the first guide 246.

A first flow path or opening 258 may be provided between the first guide 246 and the diffusion portion 241. The first guide 246 may be spaced apart from the diffusion portion 241 to define the first flow path 258 between the first guide 246 and the diffusion portion 241. The gas diffused through the diffusion portion 241 may flow through the first flow path 258.

The second guide 251 may have a ring shape corresponding to the ring shape of the first guide 246, and the diffusion portion 241 and the first guide 246 may be located at a center of the second guide 251. The second guide 251 may be concentric with the diffusion portion 241 and the first guide 246 and may be spaced apart from the first guide 246.

An inner diameter of the first guide 246 may be larger than the diameter of the diffusion portion 241, and an inner diameter of the second guide 251 may be larger than an outer diameter of the first guide 246. Accordingly, the first flow path 258 may be defined between the diffusion portion 241 and the first guide 246, and a second flow path or opening 259 may be defined between the first guide 246 and the second guide 251.

The gas diffused by the diffusion portion 241 may flow through the first flow path 258 and the second flow path 259. An outer diameter of the second flow path 259 may be larger than the diameter of the gas inlet hole 215, so that the gas introduced through the gas inlet hole 215 may be diffused by the diffusion portion 241 and flow with a larger flow cross-section.

The light irradiator 260 may be located in front of the guide frame 240 and installed on a front surface of the guide frame 240. The light irradiator 260 may have a plurality of light emitters 262 (e.g., light emitting diodes or LEDs) arranged on a circuit board 265. The circuit board 265 may include a plurality of circuit boards separated from each other, and the plurality of boards of the circuit board 265 may have a size, shape and arrangement corresponding to that of the diffusion portion 241, the first guide 246, and the second guide 251 of the guide frame 240. The circuit board 265 may not interfere with gas or air flowing through the first and second flow paths 258 and 259.

The plurality of circuit boards 265 may respectively include a central board or base 266, a first board or ring 267, and a second board or ring 268. The central board 266 may have a cross-sectional shape corresponding to the diffusion portion 241. For example, the diffusion portion 241 may have the circular cross-section, and the central board 266 may have a circular cross-section in the same manner as the diffusion portion 241. The central board 266 may be provided on or at a front surface of the diffusion portion 241 and may include a plurality of light emitters 262.

The first board 267 may have a shape corresponding to the first guide 246. For example, the first guide 246 may have a ring shape, and the first board 267 may have a ring shape in the same manner as the first guide 246. The first board 267 be provided on or at a front surface of the first guide 246 and may include a plurality of light emitters 262.

The second board 268 may have a shape corresponding to the second guide 251. For example, the second guide 251 may have a ring shape, and the second board 268 may have a ring shape in the same manner as the second guide 251. The second board 268 may be provided on or at a front surface of the second guide 251 and may include a plurality of light emitters 262.

The central board 266, the first board 267, and the second board 268 may be arranged to be concentric like the diffusion portion 241, first guide 246, and second guide 251 of the guide frame 240. The first board 267 may be outwardly or radially spaced apart from the central board 266, and the second board 268 may be outwardly or radially spaced apart from the first board 267. An inner diameter of the first board 267 may be larger than a diameter of the central board 266, and an inner diameter of the second board 268 may be larger than an outer diameter of the first board 267. Like the guide frame 240, the first flow path 258 may be located between the central board 266 and the first board 267, and the second flow path 259 may be located between the first board 267 and the second board 268.

A position of the light irradiator 260 may be secured by a coupling between the light diffusion frame 280 and the guide frame 240, which will be described later. Alternatively, the central board 266, the first board 267, and the second board 268 may be optionally coupled (e.g., adhered, welded, or pressed-fit) to front surfaces of the diffusion portion 241, the first guide 246, and the second guide 251, respectively. The circuit board 265 may include optional tabs or connectors corresponding to the guide connectors 253 to connect the central board 266, the first board 267, and the second board 268 to each other. When such optional connectors are included, the optional connectors may be coupled to (e.g., adhered, welded, or pressed-fit) to the guide connectors 254 of the guide frame 140 and/or light diffusion connectors 288 of the light diffusion frame 280 described later. As another alternative, when such optional connectors are included, the circuit board 265 may be coupled to just one or two of the front surfaces of the diffusion portion 241, the first guide 246, and the second guide 251. For example, the central board 266 may be secured to the diffusion portion 241, while the first and second boards 267 and 268 merely contact and/or are merely positioned to align with the first guide 246, and the second guide 251, respectively.

The light irradiator 260 may irradiate light toward the front side 211 of the diffusing case 210 through the plurality of light emitters 262. The light irradiated from the light irradiator 260 may be emitted toward a location ahead or forward of the diffuser 200 through the front side 211 of the diffusing case 210.

For example, the light irradiated from the light irradiator 260 may pass through the open surface of the diffusing case 210 and through the gas discharge holes 305 of the discharge cover 300, through the massage protrusion 310 of the discharge cover 300, or, if the discharge cover 300 is made of a transparent or translucent material, through a main body or portion the discharge cover 300.

As the light is irradiated forward from the diffuser 200, the diffuser 200 may treat a user's hair or scalp care. The light irradiated from the light irradiator 260 may contribute to improving scalp and hair health while drying the user's scalp or hair or while providing heat to the user's scalp or hair. The wavelength of the light irradiated from the light emitter 262 may be predetermined or may be selected by the user. For example, red light (620-660 nm) may be used to prevent hair loss or increase blood flow to the scalp, or UV light (100-400 nm) may be used to sanitize the scalp or treat skin conditions such as scalp psoriasis.

The proximity sensor 269 may be provided on the circuit board 265 of the light irradiator 260. FIG. 6 shows a state in which the proximity sensor 269 is provided on the central board 266 of the light irradiator 260.

The proximity sensor 269 may be provided at a center of the central board 266. The proximity sensor 269 may be provided to measure a separation distance from the target positioned in front of the proximity sensor 269. The controller 115 may be provided to control the light irradiator 260 based on the separation distance between the proximity sensor 269 and the target measured by the proximity sensor 269.

For example, when the separation distance from the target measured by the proximity sensor 269 is equal to or less than a reference or predetermined distance, the controller 115 may control the light irradiator 260 such that the light irradiator 260 irradiates the light forward via the light emitters 262. The reference distance may be predetermined in terms of a design or control. The light irradiator 260 may also be operated through a physical switch, which may be operated even when the separation distance measured by the proximity sensor 269 is equal to or less than the reference distance. As the proximity sensor 269 is used, the light irradiator 260 may be operated when the separation distance from the target in front of the diffuser 200 (i.e., the scalp or the hair of the user) is equal to or less than the reference distance, thereby improving ease of use and an operation efficiency.

The proximity sensor 269 may be provided in various types. For example, the proximity sensor 269 may be a pressure sensor that detects whether a pressing force is applied from the user's scalp or hair, or a photosensitive sensor that measures a level at which an amount of sensed light decreases as the separation distance from the scalp or the hair decreases.

In addition, the proximity sensor 269 may be an infrared (IR) sensor that measures an infrared ray transmitted from the target to measure the separation distance from the scalp or the hair. In this case, the proximity sensor 269 may be provided to irradiate the infrared ray forward.

The light diffusion frame 280 may be located in front of the light irradiator 260. The light diffusion frame 280 may be installed on a front surface of the light irradiator 260 to forwardly cover the light emitters 262 of the light irradiator 260.

The light diffusion frame 280 may include a central light diffusion portion or diffuser 282, a first light diffusion portion or diffuser 284 and a second light diffusion portion or diffuser 286. The light diffusion frame 280 may further include a light diffusion connector or rib 288 to connect the central light diffusion portion 282, the first light diffusion portion 284, and the second light diffusion portion 286 to each other.

The central light diffusion portion 282 may have a cross-sectional shape corresponding to that of the central board 266. For example, the central board 266 may have a circular cross-section, and the central light diffusion portion 282 may have a circular cross-section in the same manner as the central board 266 and may cover the front surface of the diffusion portion 241.

The first light diffusion portion 284 may have a shape corresponding to the first board 267. For example, the first board 267 may have the previously described ring shape, and the first light diffusion portion 284 may have a ring shape in the same manner as the first board 267 and may cover the front surface of the first board 267.

The second light diffusion portion 286 may have a shape corresponding to the second board 268. For example, the second board 268 may have the previously described ring shape, and the second light diffusion portion 286 may have a ring shape in the same manner as the second board 268 and may cover the front surface of the second board 268.

The central light diffusion portion 282, the first light diffusion portion 284, and the second light diffusion portion 286 may be arranged to be concentric like the arrangement of the guide frame 240 and the light irradiator 260. The first light diffusion portion 284 may be outwardly spaced apart from the central light diffusion portion 282, and the second light diffusion portion 286 may be outwardly spaced apart from the first light diffusion portion 284 so as not to block a flow of discharged air or gas.

An inner diameter of the first light diffusion portion 284 may be larger than a diameter of the central light diffusion portion 282, and an inner diameter of the second light diffusion portion 286 may be larger than an outer diameter of the first light diffusion portion 284. Like the guide frame 240, the first flow path 258 may be located between the central light diffusion portion 282 and the first light diffusion portion 284, and the second flow path 259 may be located between the first light diffusion portion 284 and the second light diffusion portion 286.

The diffuser 200 may be provided in a shape in which the first flow path 258 and the second flow path 259 are extended in the front and rear directions through the guide frame 240, the light irradiator 260, and the light diffusion frame 280. The light diffusion connector 288 may be provided in a shape corresponding to the guide connector 253. For example, the guide connector 253 and the light diffusion connector 288 may have an extended shape along the radial direction of the diffuser 200.

The light diffusion connector 288 may be located in front of and aligned with the guide connector 253 so as not to block a flow of discharged air or gas. The light diffusion frame 280 may be fixed inside the diffusing case 210 as the light diffusion frame 280 is fastened to the guide connector 253.

An embodiment of the present disclosure is advantageous in terms of a design and structurally stable in that, in a state in which the guide frame 240 is constituted by a plurality of components, the plurality of components may be able to be handled as a single component through the guide connector 253. In addition, an embodiment of the present disclosure is advantageous in terms of the design and structurally stability in that, in a state in which the light diffusion frame 280 is constituted by a plurality of components, the plurality of components are able to be handled as a single component through the light diffusion connector 288.

Furthermore, the light diffusion connector 288 of the light diffusion frame 280 may be coupled to the guide connector 253 of the guide frame 240, so that all of the central light diffusion portion 282, the first light diffusion portion 284, and the second light diffusion portion 286 may be stably fixed and secure, which is advantageous in terms of coupling.

The light diffusion frame 280 may be made of a material through which light is transmitted (i.e., a transparent or translucent material, such as plastic or glass). The light irradiated from the light irradiator 260 may be scattered and diffused while passing through the light diffusion frame 280. The light diffusion frame 280 may be provided in front of the light irradiator 260 so that the light irradiated from the light irradiator 260 may be provided to the user while being scattered and diffused and being uniformly dispersed in a larger area.

A treatment for the diffusion or the scattering of the light may be performed on a front surface or a rear surface of the light diffusion frame 280. For example, etching may be performed or a pattern through laser processing and the like may be formed on a surface of the light diffusion frame 280.

In one example, the central light diffusion portion 282 may shield the front surface of the central board 266, and a portion of the central light diffusion portion 282 in front of the proximity sensor 269 may be opened or formed with a hole such that the measurement of the separation distance from the target in front of the diffuser 200 via the proximity sensor 269 may be convenient or undisturbed. When the proximity sensor 269 is provided at the center of the central board 266, the central light diffusion portion 282 may have a hole defined at a center thereof (as shown in the figures) to expose the proximity sensor 269 forwardly and allow transmission of a signal to or from the proximity sensor 269.

The discharge cover 300 may shield the open surface defined in the front side 211 of the diffusing case 210 in which the guide frame 240, the light irradiator 260, and the light diffusion frame 280 may be embedded. The plurality of gas discharge holes 305 may be defined in the discharge cover 300 so that gas may be discharged and the light may be irradiated forward.

The edge 302 of the discharge cover 300 may have a curvature configured to correspond to that of the front circumferential portion 236 of the diffusing case 210 when viewed from the side. A front surface of the discharge cover 300 may form a curved surface that is indented or recessed rearwards centerwardly so that the discharge cover 300 may have a shape corresponding to the head of the user, which may facilitate a massage effect through the massage protrusions 310 while providing the gas or air and the light to the user.

The plurality of massage protrusions 310 may each have a contact portion provided on a front surface or end thereof. The contact portions of the plurality of massage protrusions 310 may be configured such that a sense of touch with the scalp or the hair of the user may be improved and damage to the scalp and the hair may be minimized. For example, the contact portion may be made of an elastic or soft material such as silicon, rubber, or plastic.

The discharge cover 300 may also include at least one moisture measurement protrusion or sensor 312, which may also serve as a massage protrusion 310. The moisture measurement protrusion 312 may be provided to measure a moisture amount of the scalp or the hair of the user. A pair of moisture measurement protrusions 312 may be arranged to measure an impedance, such as a bioelectrical impedance through an electric field formed therebetween.

The moisture measurement protrusions 312 may be connected to the controller 115. The controller 115 may determine the impedance using a voltage, a current, a resistance, and the like, which are identified through the moisture measurement protrusion 312, and determine the moisture amount of the scalp or the hair of the user based on the determined impedance. The controller 115 may further control an operation of the fan 119, the temperature adjuster 117, or the light irradiator 260 based on the determined moisture amount.

For example, the controller 115 may control the fan 119 to increase a rotation speed (such that the speed of discharged gas increases) as the determined moisture amount of the scalp or the hair of the user increases. Alternatively or in addition thereto, the controller 115 may control the temperature adjuster 117 such that a temperature of the discharged gas increases and/or control the light irradiator 260 such that a light amount or intensity increases as the determined moisture amount of the scalp or the hair of the user increases. A light amount or intensity may be increased by increasing a number of light emitters 262 emitting light and/or increasing an intensity of light emitted by each light emitter 262.

A pair of moisture measurement protrusions 312 may include a first moisture measurement protrusion 315 electrically having a first pole and a second moisture measurement protrusion 316 having a second pole opposite to the first pole. The controller 115 may determine the impedance and the moisture amount through the electric field formed between the first moisture measurement protrusion 315 and the second moisture measurement protrusion 316.

A plurality of pairs of moisture measurement protrusions 312, each of which includes the first moisture measurement protrusion 315 and the second moisture measurement protrusion 316, may be arranged. One pair of moisture measurement protrusions 312 may be provided to be spaced apart from another pair of moisture measurement protrusions 312, and different massage protrusions 310 may be positioned therebetween.

In one example, the open region 303 may be defined at a center of the discharge cover 300. The proximity sensor 269 may be exposed forward through the hole defined in the light diffusion frame 280 and the open region 303 of the discharge cover 300, and may measure the separation distance from the target in front of the diffuser 200. A protection member (e.g., a transparent film or layer) that protects the proximity sensor 269 and allows the infrared ray or the like to pass straight therethrough may be provided in front of the proximity sensor 269 (e.g., in a center hole of the light diffusion frame or in the open region 303).

Referring to FIG. 7, the first coupling portion 120 of the main body 110 may include the first magnetic fastening portion 127, and the second coupling portion 220 of the diffuser 200 may include the second magnetic fastening portion 227. The diffuser 200 may be coupled to the front end 112 of the main body 110 through a magnetic coupling or interaction between the first magnetic fastening portion 127 and the second magnetic fastening portion 227. The first coupling portion 120 may further include a hook fastener or loop, and the second coupling portion 220 may further include a hook configured to be fastened to the hook fastener so that a coupling stability between the diffuser 200 and the main body 110 may be enhanced.

Hereinafter, a flow of the gas discharged from the gas outlet 150 according to an embodiment of the present disclosure will be described with reference to FIG. 7. In the gas outlet 150, the gas is discharged from the center opening 154 and the side opening 156. The gas inlet hole 215 of the diffusing case 210 may have a diameter equal to or larger than that of the side opening 156 and face the gas outlet 150 so that the gas discharged from the center opening 154 and the side opening 156 may be introduced into the inlet hole 215.

The guide frame 240 may be provided inside the diffusing case 210 to face the gas outlet 150. The diffusion portion 241 of the guide frame 240 may be positioned to face the center opening 154 of the gas outlet 150.

The gas discharged from the center opening 154 may flow toward the diffusion portion 241. As the diffusion portion 241 has a diameter larger than that of the center opening 154, the gas discharged from the center opening 154 may be diffused outward along the radial direction of the diffuser 200.

The diffusion portion 241 may have a diffusion protrusion or cone 242 on a rear surface thereof facing the center opening 154. The diffusion protrusion 242 may have a curvature such that a diameter thereof decreases in a rearward direction to protrude or point toward the gas outlet 160. The diameter of the diffusion protrusion 242 may decrease toward a center, which may face the gas outlet 160. A diffusion effect of the gas discharged from the center opening 154 may be improved by the diffusion protrusion 242.

At least a portion of the gas discharged from the center opening 154 may flow along the first flow path 258 defined between the diffusion portion 241 and the first guide 246 in the guide frame 240 by the diffusion portion 241 and the diffusion protrusion 242. In one example, the gas discharged from the side opening 156 may flow outward to surround the gas discharged from the center opening 154, and the gas discharged from the side opening 156 may also diffuse outward along the radial direction of the diffuser 200 as the gas of the center opening 154 is diffused by the diffusion portion 241. At least a portion of the gas discharged from the side opening 156 and at least a portion of the gas discharged from the center opening 154 may flow along the second flow path 259 defined between the first guide 246 and the second guide 251 in the guide frame 240.

Despite a design feature where the inner diameter of the diffuser 200 may increase in a forward direction, the discharging of the gas through the center opening 154 and the side opening 156 in the forward direction while being maintained in a specific form may be effectively suppressed through the guide frame 240. The diffuser 200 may allow the gas discharged from the center opening 154 and the side opening 156 to be effectively dispersed and diffused with a larger flow cross-sectional area while preventing the flow of the gas from being maintained in the specific form.

In one example, the light irradiator 260 and the light diffusion frame 280 may be arranged in front of the guide frame 240 inside the diffusing case 210. The light irradiator 260 and the light diffusion frame 280 may be coupled with the guide frame 240 and may be handled as a single component, improving space utilization, convenience, security, and design.

The light irradiator 260 and the light diffusion frame 280 may define the first flow path 258 and the second flow path 259 together with the guide frame 240. The flow of the gas formed by the guide frame 240 may be effectively maintained, and the gas may be discharged forward from the diffuser 200 through the light irradiator 260 and the light diffusion frame 280.

In the light irradiator 260, the first board 267 may be positioned to be forward or in front of the central board 266, and the second board 268 may be positioned to be forward or in front of the first board 267. The plurality of light emitters 262 arranged in the light irradiator 260 may be arranged to form a spherical or curved surface that is indented or recessed rearward. The plurality of light emitters 262 may be arranged in a form in which a distance from a center of the light irradiator 260 along the radial direction increases forwardly. Such arrangement of the light emitters 262 may correspond to the shape of the front surface of the discharge cover 300 indented rearward. The plurality of light emitters 262 arranged on the light irradiator 260 may be arranged to form the curved surface to correspond to the user's head having a curvature, so that a uniform amount of light may be provided to the user's scalp and hair.

Like the light irradiator 260, the guide frame 240 may be provided such that the first guide 246 may be positioned forward or in front of the diffusion portion 241, and the second guide 251 may be positioned forward or in front of the first guide 246. The first board 267 provided on the front surface of the first guide 246 may be positioned forward or in front of the central board 266 provided at the front surface of the diffusion portion 241, and the second board 268 provided at the front surface of the second guide 251 may be positioned forward or in front of the first board 267.

Like the light irradiator 260, in the light diffusion frame 280, the first light diffusion portion 284 may be positioned forward or in front of the central light diffusion portion 282, and the second light diffusion portion 286 may be positioned forward or in front of the first light diffusion portion 284. A distance between the light diffusion frame 280 and the light irradiator 260 may be kept constant, and uniform dispersion and scattering of the light may be induced. In the guide frame 240, as the second guide 251 may be positioned forward of the first guide 246 and the first guide 246 may be positioned forward of the diffusion portion 241, a space in which the gas introduced from the gas inlet hole 215 is diffused in the radial direction may be secured, and the gas may be smoothly introduced into the first flow path 258 and the second flow path 259.

FIG. 7 shows the guide frame 240, the light irradiator 260, and the light diffusion frame 280 protruding forward in a direction away from centers thereof.

FIG. 7 also shows a light blocking portion or shield 271 surrounding the proximity sensor 269. The light blocking portion 271 may have a hollow cylindrical shape, but embodiments disclosed herein are not limited. The light blocking portion 271 may be provided to surround the proximity sensor 269 along a circumferential direction of the diffuser 200, preventing a situation in which the light emitter 262 around the proximity sensor 269 affects a measurement the proximity sensor 269. The proximity sensor 269 may be located inside the light blocking portion 271. The light blocking portion 271 may have a shape extending from the central board 266 to the discharge cover 300.

The light blocking portion 271 may be opened in a forward direction to prevent structural interference from occurring in a measurement of the separation distance between the diffuser 200 and the front target by the proximity sensor 269. For example, when the proximity sensor 269 measures an infrared ray transmitted from the target, the light blocking portion 271 may have a front opening to allow the infrared ray transmitted from the target to be completely provided to the proximity sensor 269.

The light blocking portion 271 may be provided to extend rearward from the discharge cover 300, or may be formed integrally with the discharge cover 300 or integrally with the central board 266. The light blocking portion 271 may be manufactured separately from the discharge cover 300 and the central board 266, and may be later coupled to or combined with the discharge cover 300 and/or the central board 266.

As described above, the hair dryer 100 may include the main body 110, the handle 180, and the diffuser 200. The main body 110 may include the gas outlet 150 to discharge the gas introduced from the outside, and the handle 180 may extend from the main body 110.

The diffuser 200 may be removably coupled to the main body 110 so that the gas discharged from the gas outlet 150 may flow into the diffuser 200, and the gas introduced into the diffuser 200 may be discharged to the outside. The diffuser 200 may include the diffusing case 210 and the guide frame 240. The rear side 212 of the diffusing case 210 may be coupled to the main body 110, the gas discharged from the gas outlet 150 may be introduced into the diffusing case 210 through the gas inlet hole 215 defined in the rear side 212, the gas introduced into the diffusing case 210 may be discharged from the front side 211, and the inner diameter of the diffusing case 210 may increase toward the front side 211 from the rear side 212.

The light irradiator 260 may be provided inside the diffusing case 210 to irradiate the light toward the front side 211 of the diffusing case 210. The light diffusion frame 280 may be located in front of the light irradiator 260, and the light irradiated from the light irradiator 260 may be transmitted and diffused forward.

Figure 8:
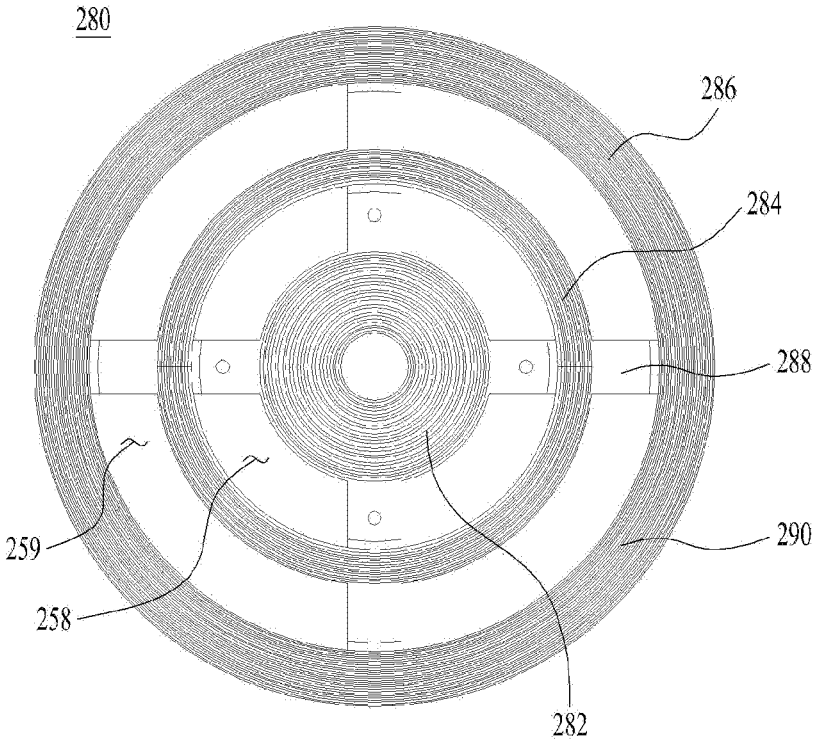
FIG. 8 is a view of a light diffusion frame according to an embodiment.

Referring to FIGS. 6 and 8, the light diffusion frame 280 may be made of various materials that may transmit light, such as a plastic material or a glass material. The light irradiated from the light irradiator 260 may be diffused through the light diffusion frame 280. The light irradiator 260 may irradiate the light from the plurality of light emitters 262. Thus, a greater amount of light may be transmitted to a region located directly in front of the light emitter 262.

However, the light irradiated from the light irradiator 260 may be suppressed from being concentrated in a specific region. Furthermore, the light transmitted through the light diffusion frame 280 may be provided to the user by forming a larger area by the diffusion.

In an embodiment, the inner diameter of the diffusing case 210 may increase forwardly, and thus an open surface of the diffusing case 210 may have a larger cross-sectional area than the light irradiator 260. When the light diffusion frame 280 is omitted, a smaller amount of light may be provided to a circumference of the front opening of the diffusing case 210 because of an area difference from the light irradiator 260. However, an embodiment of the present disclosure may provide a more uniform amount of light to a larger area by diffusing the light via the light diffusion frame 280, which may be placed in front of the light irradiator 260.

Figure 9:
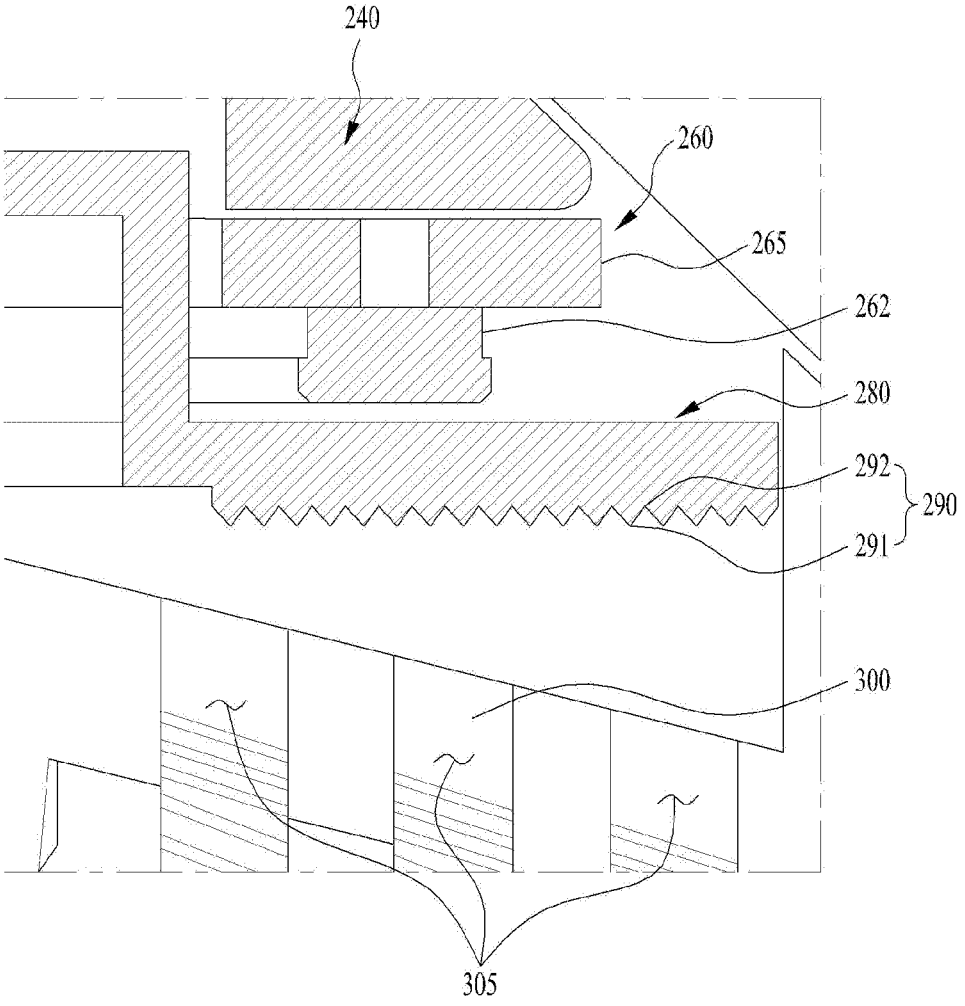
FIG. 9 is a view showing a light diffusion pattern formed on a light diffusion frame according to an embodiment.

Referring to FIG. 9, a light diffusion pattern 290 having a convex portion 291 alternately arranged with a concave portion 292 may be formed on a front surface of the light diffusion frame 280 to induce diffusion of the emitted light. The light diffusion pattern 290 may be, for example, a zig-zag pattern, ridge pattern, or wave pattern.

The light diffusion pattern 290 may be formed on the front surface, the rear surface, or inside of the light diffusion frame 280. The light diffusion pattern 290 may be post-processed by an etching method, a laser method, etc., or molded through a shape of injection molding.

When the light diffusion pattern 290 is formed on the front surface of the light diffusion frame 280, the convex portion 291 may mean a portion or a region protruding forward from the concave portion 292, and the concave portion 292 may mean a portion or a region indented or recessed rearwards of the convex portion 291. The convex portion 291 and the concave portion 292 may be determined in a relative relationship therebetween.

The convex portion 291 and the concave portion 292 may be alternately arranged with each other in various schemes. For example, the light diffusion pattern 290 may be in an embossed shape in which the convex portion 291 and the concave portion 292 are alternately arranged with each other in all directions, or may be in a wave shape in which the convex portion 291 and the concave portion 292 are alternately arranged with each other in a radial direction of the diffusion frame 280. The convex and/or concave portions 291 and 292 may have straight edges and vertices to resemble teeth, as shown in the drawings, or alternatively may be curved, similar to the first and second portions 237 and 238 of the front circumferential portion 236 of the diffuser case 200.

FIGS. 8 and 9 show a zig-zag shaped light diffusion pattern 290 in which the convex portion 291 and the concave portion 292 are alternately arranged with each other along the radial direction of the light diffusion pattern 290 according to an embodiment. The light diffusion pattern 290 may be uniformly distributed on the front surface of the light diffusion frame 280, or may be concentrated and distributed in a specific region. For example, when there is a specific region in which a separation distance between the light emitters 262 in the light irradiator 260 is relatively small, a denser light diffusion pattern 290 may be formed in a portion corresponding to the specific region of the front surface of the light diffusion frame 280. A molding scheme and a distribution form of the light diffusion pattern 290 may be variously determined by design.

In one example, the light irradiator 260 may include the plurality of light emitters 262 respectively arranged on the plurality of circuit boards 265 to emit the light. The light diffusion frame 280 may be formed in a shape corresponding to the plurality of circuit boards 265 to cover the front surfaces of the plurality of circuit boards 265.

The light diffusion frame 280 may be provided to entirely cover the plurality of light emitters 262 arranged in the light irradiator 260 and diffuse the light while minimizing an unnecessary area thereof. The light diffusion frame 280 may have spaces so as not to obstruct the first and second flow paths 258 and 259.

As the light diffusion frame 280 is formed in the shape corresponding to the plurality of circuit boards 265 of the light irradiator 260 when viewed from the front, the light diffusion frame 280 may be handled with the light irradiator 260 in an assembly process, which may be advantageous.

In one example, the plurality of circuit boards 265 may include the central board 266, the first board 267, and the second board 268. Further, the light diffusion frame 280 may include the central light diffusion portion 282, the first light diffusion portion 284, and the second light diffusion portion 286.

The central light diffusion portion 282 may have a cross-sectional shape corresponding to that of the central board 266 and may be provided to cover the front surface of the central board 266. The first light diffusion portion 284 may have a cross-sectional shape corresponding to that of the first board 267 and may be provided to cover the front surface of the first board 267. The second light diffusion portion 286 may have a cross-sectional shape corresponding to that of the second board 268 and may be provided to cover the front surface of the second board 268.

The light diffusion frame 280 may be provided to diffuse the light of the light irradiator 260, and a shape of the light irradiator 260 may be limited by the light diffusion frame 280. However, such limitation where the light diffusion frame 280 may correspond to the cross-sectional shape of the light irradiator 260 may be advantageous in the design of the light irradiator 260. Further, because the light diffusion frame 280 includes the central light diffusion portion 282, the first diffusion portion 284, and the second diffusion portion 286 respectively corresponding to the central board 266, the first board 267, and the second board 268 of the light irradiator 260, the light diffusion frame 280 may be provided in front of the light irradiator 260 while minimizing an unnecessary region in the light diffusion.

Figure 10:
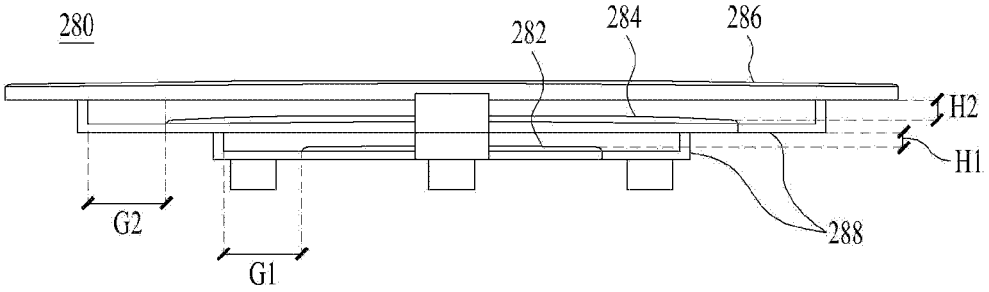
FIG. 10 is a view of a light diffusion frame according to an embodiment.

Referring to FIG. 10, the first flow path 258 through which the gas flows may be defined between the central board 266 and the first board 267 and between the central light diffusion portion 282 and the first light diffusion portion 284, and the second flow path 259 through which the gas flows may be defined between the first board 267 and the second board 268 and between the first light diffusion portion 284 and the second light diffusion portion 286.

Based on the radial direction of the light diffusion frame 280, a separation distance G1 may be formed between the central light diffusion portion 282 and the first light diffusion portion 284, and a separation distance G2 may be formed between the first light diffusion portion 284 and the second light diffusion portion 286 in the light diffusion frame 280.

The light diffusion frame 280 may be formed in the shape corresponding to the light irradiator 260. Thus, in the circuit board 265 of the light irradiator 260, the separation distance G1 may be formed between the central board 266 and the first board 267, and the separation distance G2 may be formed between the first board 267 and the second board 268. G1 and G2 may have the same value, or alternatively may be different from each other as necessary.

A separation space between the central light diffusion portion 282 and the first light diffusion portion 284 may correspond to the first flow path 258. Similarly, a separation space between the central board 266 and the first board 267 may correspond to the first flow path 258. The central light diffusion portion 282, the central board 266, the first light diffusion portion 284, and the first board 267 may contribute to defining the first flow path 258 together. The separation distance G1 may correspond to a width of the first flow path 258.

The separation space between the first light diffusion portion 284 and the second light diffusion portion 286 may correspond to the second flow path 259. The separation space between the first board 267 and the second board 268 may correspond to the second flow path 259. The first light diffusion portion 284, the first board 267, the second light diffusion portion 286, and the second board 268 may contribute to defining the second flow path 259 together. The separation distance G2 may correspond to a width of the second flow path 259.

The light diffusion frame 280 may be formed in the shape corresponding to the light irradiator 260 such that the separation distance G1 is formed between the central light diffusion portion 282 and the first light diffusion portion 284 and such that the separation distance G2 is formed between the first light diffusion portion 284 and the second light diffusion portion 286. The first flow path 258 and the second flow path 259 through which the gas flows may be extended through the light diffusion frame 280 as well as the light irradiator 260, facilitating smooth gas discharge toward the front side of the diffuser 200.

The first board 267 may be provided forward from and spaced apart from the central board 266, and the second board 268 may be provided forward from and spaced apart from the first board 267. Further, the first light diffusion portion 284 may be provided forward from and spaced apart from the central light diffusion portion 282, and the second light diffusion portion 286 may be provided forward from and spaced apart from the first light diffusion portion 284.

A separation distance H1 may be formed between the central light diffusion portion 282 and the first light diffusion portion 284 in the front-rear direction of the diffuser 200, and a separation distance H2 may be formed between the first light diffusion portion 284 and the second light diffusion portion 286 in the front-rear direction. H1 and H2 may have the same value as each other, or alternatively may have different values as necessary.

The light diffusion frame 280 may cover the plurality of circuit boards 265 of the light irradiator 260. The separation distance H1 may be formed between the central board 266 and the first board 267 and the separation distance H2 may be formed between the first board 267 and the second board 268 as in the light diffusion frame 280.

As the first board 267 located farther in the radial direction than the central board 266 is provided forwardly of the central board 266, and as the second board 268 located farther in the radial direction than the first board 267 is provided forwardly of the first board 267, the light irradiator 260 may provide light having a more uniform light distribution to the user based on the user's head having a specific curvature. As the first light diffusion portion 284 is provided forwardly of the central light diffusion portion 282 and the second light diffusion portion 286 is provided forwardly of the first light diffusion portion 284 corresponding to the light irradiator 260 provided as above, distances between the plurality of circuit boards 265 of the light irradiator 260 and the light diffusion frame 280 may be uniformly set, so that the light diffusion frame 280 may provide a uniform amount of light dispersion.

Figure 11:
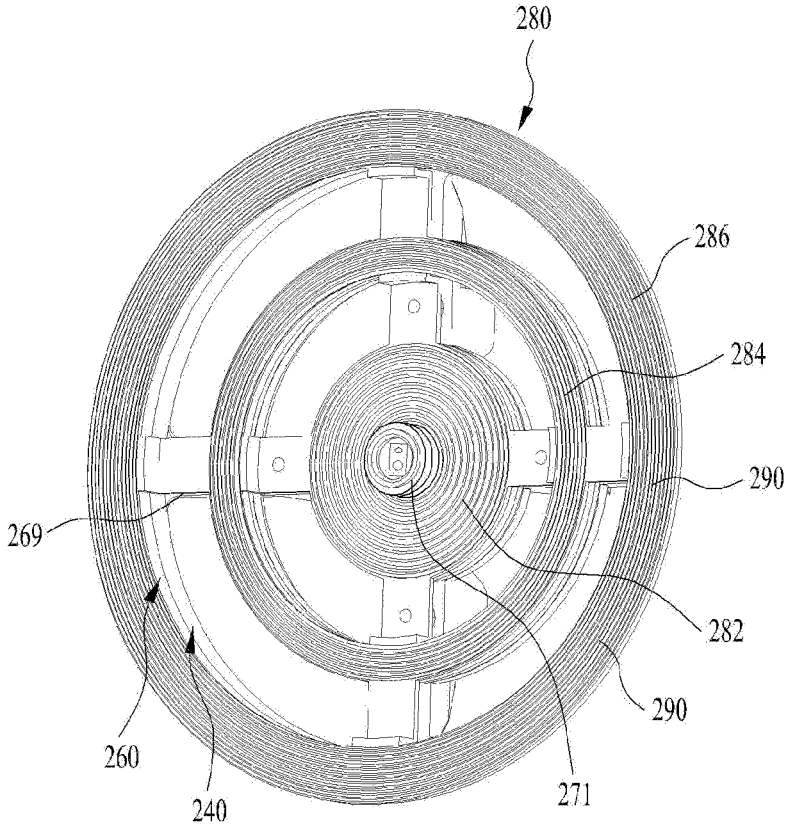
FIG. 11 is a view of a light diffusion frame in a diffuser according to an embodiment.

Referring to FIGS. 10 and 11, the light diffusion frame 280 may further include a light diffusion connector or rib 288. The light diffusion connector 288 may extend along the radial direction of the light diffusion frame 280 to connect the central light diffusion portion 282, the first light diffusion portion 284, and the second light diffusion portion 286 to each other.

The light diffusion connector 288 may be formed in a single bar or tab shape to connect the central light diffusion portion 282, the first light diffusion portion 284, and the second light diffusion portion 286 to each other, or may be formed in a shape having steps based on positional deviations between the central light diffusion portion 282, the first light diffusion portion 284, and the second light diffusion portion 286 as shown in FIG. 10.

The light diffusion frame 280 may be constituted by the central light diffusion portion 282, the first light diffusion portion 284, and the second light diffusion portion 286 so as to correspond to the light irradiator 260. Thus, the first flow path 258 or the second flow path 259 through which the gas flows may be defined between the central light diffusion portion 282, the first light diffusion portion 284, and the second light diffusion portion 286. The central light diffusion portion 282, the first light diffusion portion 284, and the second light diffusion portion 286 may be integrally handled through the light diffusion connector 288, which may be advantageous in manufacturing and assembly.

The diffuser 200 may further include the guide frame 240, and the guide frame 240 may include the diffusion portion 241, the first guide 246, and the second guide 251. The diffusion portion 241 may be provided to face the gas inlet hole 215 to diffuse the gas introduced through the gas inlet hole 215, and the central board 266 may be provided on the front surface of the diffusion portion 241. The first guide 246 may be formed in the ring shape and have the diffusion portion 241 located at the center thereof, the first flow path 258 may be defined between the first guide 246 and the diffusion portion 241, and the first board 267 may be provided on the front surface of first guide 246.

The second guide 251 may be formed in the ring shape and have the diffusion portion 241 and the first guide 246 located at the center thereof, the second flow path 259 may be defined between the first guide 246 and the second guide 251, and the second board 268 may be provided on the front surface of the second guide 251.

The gas introduced into the diffuser 200 may be diffused in the radial direction of the diffuser 200 by the guide frame 240, and may flow through the first flow path 258 and the second flow path 259.

The central board 266 may be provided on the front surface of the diffusion portion 241, and the central light diffusion portion 282 may be located in front of the diffusion portion 241 and the central board 266. The first board 267 may be provided on the front surface of the first guide 246, and the first light diffusion portion 284 may be located in front of the first guide 246 and the first board 267. The second board 268 may be provided on the front surface of the second guide 251, and the second light diffusion portion 286 may be located in front of the second guide and the second board 268.

The guide frame 240, the light irradiator 260, and the light diffusion frame 280 may define the first flow path 258 and the second flow path 259 together, so that, even when a plurality of components such as the guide frame 240, the light irradiator 260, and the light diffusion frame 280 are arranged inside the diffuser 200, the gas may be effectively diffused and discharged forwardly of the diffuser 200.

In addition, the guide frame 240, the light irradiator 260, and the light diffusion frame 280 may have cross-sectional shapes corresponding to each other and form mutual coupling relations, so that the guide frame 240, the light irradiator 260, and the light diffusion frame 280 may be integrally handled in the manufacturing and the assembly, which may be advantageous. A stable structure may be implemented without forming a coupling structure of the diffusing case 210 for each of the guide frame 240, the light irradiator 260, and the light diffusion frame 280 inside the diffusing case 210.

The guide frame 240 may further include the guide connector 253, and the light diffusion connector 288 of the light diffusion frame 280 may be located in front of the guide connector 253 and coupled to the guide connector 253.

The plurality of components of the guide frame 240 may be treated as a single component through the guide connector 253, and the plurality of components of the light diffusion frame 280 may be treated as a single component through the light diffusion connector 288.

Furthermore, the light diffusion frame 280 may be fixed to the guide frame 240, as the light diffusion connector 288 may be fastened to the guide connector 253. The light diffusion frame 280 may have a very simple fastening structure, and the light diffusion frame 280, guide frame 240, and light irradiator 260 may be treated as one component.

The proximity sensor 269 may be provided on the central board 266 to measure the separation distance from the target positioned in front of the diffusing case 210. A portion of the central light diffusion portion 282 corresponding to the proximity sensor 269 may be opened or have an opening so as not to obstruct a measurement of the proximity sensor 269.

As the portion of the central light diffusion portion 282 corresponding to or aligned with the proximity sensor 269 is opened, the proximity sensor 269 may smoothly measure the distance from the front target, for example, the scalp or the hair of the user, without structural limitations. As one example, the proximity sensor 269 may be provided to sense an infrared ray transmitted or reflected from the target to measure the separation distance from the target.

An embodiment of the present disclosure may further include the light blocking portion 271 provided to surround the proximity sensor 269 to shield the plurality of light emitters 262 from the proximity sensor 269. As previously described, the light blocking portion 271 may also have a front opening so that an infrared ray transmitted from the target may be provided to the proximity sensor 269.

The light blocking portion 271 may be provided to extend along the front and rear direction and penetrate the central light diffusion portion 282. The light blocking portion 271 may be provided to have a hollow pipe shape, and the proximity sensor 269 may be located in a hollow portion at a central side of the light blocking portion 271. Interference between the proximity sensor 269 and the plurality of light emitters 262 may be blocked by the light blocking portion 271.

The light blocking portion 271 may extend forward while penetrating a hole defined in the light diffusion frame 280 and may have an open front surface. The proximity sensor 269 provided to measure the infrared ray may smoothly measure the infrared ray transmitted from the scalp or the hair of the user.

A portion of the discharge cover 300 located in front of the proximity sensor 269 may be opened to define the open region 303. All the regions of the discharge cover 300, the light blocking portion 271, and the light diffusion frame 280 located in front of the proximity sensor 269 may be opened so that the proximity sensor 269 may smoothly measure the separation distance from the front target.

A protection member (e.g., transparent film or layer) that shields the front side of the proximity sensor 269 but effectively transmits the infrared ray may be provided inside the light blocking portion 271 as needed. In one example, the light blocking portion 271 may be provided on the discharge cover 300 to extend rearward from the rear surface of the discharge cover 300 while surrounding the open region 303.

Figure 12:
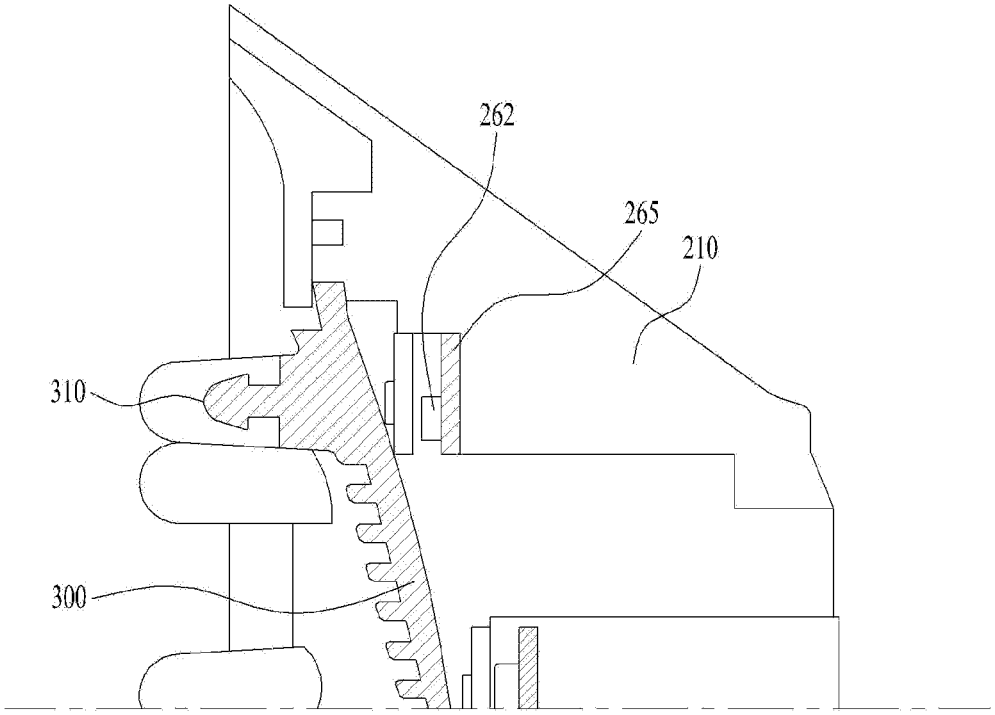
FIG. 12 is a view showing an arrangement relationship between a light emitter and a massage protrusion in a diffuser according to an embodiment.

In one example, FIG. 12 shows a state in which the light emitter 262 of the light irradiator 260 is provided rearward of the massage protrusion 310 of the discharge cover 300 according to an embodiment. Referring to FIG. 12, in an embodiment of the present disclosure, the plurality of light emitters 262 may be arranged inside the diffusing case 210 to respectively face the plurality of massage protrusions 310.

The light irradiated from the light emitter 262 may be transmitted to the massage protrusion 310 through the gas discharge hole 305, or may be transmitted to the massage protrusion 310 by passing through the discharge cover 300, which may be made of a light transmissive material. The light irradiated from the light emitter 262 may be transmitted to the scalp and the hair of the user through the massage protrusion 310 so that direct light transmission may be possible and the care effect of the scalp and the hair may be improved.

However, embodiments disclosed herein are not necessarily limited thereto. For example, some of the plurality of light emitters 262 may be respectively arranged rearward of the massage protrusions 310, while others may be arranged rearward of the gas discharge hole 305 to irradiate the light. The plurality of light emitters 262 may be evenly distributed such that separation distances therebetween are uniform, or alternatively may be concentrated in some regions as needed, regardless of the arrangement of the massage protrusions 310.

This application is related to co-pending U.S. application Ser. No. 17/077,915 filed on Oct. 22, 2020, Ser. No. 17/077,917 filed on Oct. 22, 2020, Ser. No. 17/077,921 filed on Oct. 22, 2020, Ser. No. 17/077,922 filed on Oct. 22, 2020, Ser. No. 17/077,927 filed on Oct. 22, 2020, Ser. No. 17/077,929 filed on Oct. 22, 2020, Ser. No. 17/085,385 filed on Oct. 30, 2020, and Ser. No. 17/077,119 filed on Oct. 22, 2020, the entire contents of which are incorporated by reference herein.

Embodiments disclosed herein may provide a diffuser and a hair dryer including the same capable of effectively irradiating light to a user for scalp and hair care. Embodiments disclosed herein may provide a diffuser and a hair dryer including the same with scalp and hair care effects improved by irradiating light that is uniformly dispersed and has a large area to a user. In addition, embodiments disclosed herein may provide a diffuser and a hair dryer including the same in which a plurality of components are simply and effectively fastened and an efficient flow path of gas is included.

Embodiments disclosed herein may provide an LED module as a means for user's scalp and hair care, and the LED module may be provided inside the diffuser to irradiate light such as an infrared ray and the like to the user.

Embodiments disclosed herein may provide the light having a uniform light distribution and a wide area to the user by including a light diffusion frame that effectively diffuses and scatters the light by the LED module. When the light of the LED module is diffused through an ordinary diffusion sheet or film, a light loss rate may be high and a transmittance may be low, so that it may be difficult to irradiate sufficient light to the user.

Embodiments disclosed herein may provide a light diffusion frame that is assembled and provided on front surfaces of 3 types of PCBs of the LED module. The light diffusion frame may diffuse the light provided by the LED module to evenly distribute a light amount, and serration may be applied to a surface of the light diffusion frame.

In a serration, an angle may be differentially reflected for each position of the LED module corresponding to a light source. The light diffusion frame provided on the front surfaces of the plurality of PCBs may be manufactured and handled as a single component through a light diffusion connector, thereby improving assembly and handling.

Embodiments disclosed herein may be implemented as a diffuser including a diffusing case, a light irradiator, and a light diffusion frame. The diffusing case may have a rear side removably coupled to a main body of a hair dryer, gas discharged from the main body may be introduced into the diffusing case through a gas inlet hole defined at the rear side, and the gas introduced into the diffusing case may be discharged from a front side of the diffusing case.

The light irradiator may be provided inside the diffusing case to irradiate light toward the front side of the diffusing case. The light diffusion frame may be provided in front of the light irradiator, and the light irradiated from the light irradiator may be diffused while forwardly penetrating the light diffusion frame. Embodiments disclosed herein may diffuse the light irradiated from the light irradiator by the light diffusion frame provided in front of the light irradiator, so that a light distribution degree in the same area may be improved and an area where the light is transmitted may also be effectively increased, which may be advantageous for the scalp care of the user.

A light diffusion pattern to induce the diffusion of the light may be formed on a front surface of the light diffusion frame. A convex portion and a concave portion may be alternately arranged with each other to form the light diffusion pattern.

The light irradiator may include a plurality of light emitters respectively arranged on a plurality of circuit boards to emit light. The light diffusion frame may have a shape corresponding to the plurality of circuit boards and be provided on front surfaces of the plurality of circuit boards.

The plurality of circuit board may include a central board, a first board, and a second board. The central board may be provided at a center of the light irradiator, the first board may be formed in a ring shape and have the central board provided at a center of the first board, and the second board may be formed in a ring shape and have the central board and the first board arranged at a center of the second board.

The light diffusion frame may include a central light diffusion portion, a first light diffusion portion, and a second light diffusion portion. The central light diffusion portion may have a cross-sectional shape corresponding to that of the central board and be provided on a front surface of the central board. The first light diffusion portion may have a cross-sectional shape corresponding to that of the first board and be provided on a front surface of the first board. A second light diffusion portion may have a cross-sectional shape corresponding to that of the second board be provided on a front surface of the second board.

A first flow path to flow or move the gas therethrough may be defined between the central board and the first board and between the central light diffusion portion and the first light diffusion portion. A second flow path to flow or move the gas therethrough may be defined between the first board and the second board and between the first light diffusion portion and the second light diffusion portion.

The first board may be provided to be forwardly spaced apart from the central board, and the second board may be provided to be forwardly spaced apart from the first board. The first light diffusion portion may be provided to be forwardly spaced apart from the central light diffusion portion, and the second light diffusion portion may be provided to be forwardly spaced apart from the first light diffusion portion diffuser.

The light diffusion frame may further include a light diffusion connector or rib extending along a radial direction of the light diffusion frame to connect the central light diffusion portion, the first light diffusion portion, and the second light diffusion portion to each other. The diffuser may further include a guide frame provided inside the diffusing case to guide a flow of the gas introduced through the gas inlet hole, and the guide frame may include a diffusion portion, a first guide, and a second guide.

The diffusion portion may be provided to face the gas inlet hole to diffuse the gas introduced through the gas inlet hole, and the central board may be provided on a front surface of the diffusion portion. The first guide may be formed in a ring shape to have the diffusion portion located at a center of the first guide, the first flow path may be defined between the diffusion portion and the first guide, and the first board may be provided on a front surface of the first guide. Further, the second guide may be formed in a ring shape to have the diffusion portion and the first guide at a center of the second guide, the second flow path may be defined between the first guide and the second guide, and the second board may be provided on a front surface of the second guide.

The guide frame may further include a guide connector or rib extending along a radial direction of the guide frame to connect the diffusion portion, the first guide, and the second guide to each other, and the light diffusion connector may be located in front of the guide connector and may be coupled to the guide connector.

The diffuser may further include a proximity sensor provided on the central board to measure a separation distance from a target located in front of the discharge cover, and a region of the central light diffusion portion corresponding to the proximity sensor may be opened. The proximity sensor may be provided to sense an infrared ray transmitted from the target to measure the separation distance from the target. The diffuser may further include a light blocking portion provided to surround the proximity sensor to shield the plurality of light emitters from the proximity sensor, and the light blocking portion may be opened forward such that the infrared ray transmitted from the target is provided to the proximity sensor. Further, the light blocking portion may extend along a front and rear direction to penetrate the central light diffusion portion.

The diffuser may further include a discharge cover provided at the front side of the diffusing case. The discharge cover may include a gas discharge hole to discharge the gas introduced into the diffusing case to outside, and an open region may be defined in the discharge cover at a location in front of the proximity sensor. The light blocking portion may extend rearward from a rear surface of the discharge cover while surrounding the open region.

The discharge cover may include a plurality of massage protrusions protruding forward, and the light emitters may be arranged to respectively face the plurality of massage protrusions inside the diffusing case.

Embodiments disclosed herein may be implemented as a hair dryer including a main body, a handle, and a diffuser. The main body may include a gas outlet to discharge fluid such as air or gas therethrough, the handle may extend from the main body, and the diffuser may be removably coupled to the main body to introduce the gas discharged from the gas outlet therein and discharge the gas introduced therein to outside.

The diffuser may include a diffusing case having a rear side coupled to the main body. The gas discharged from the gas outlet may be introduced into the diffusing case through a gas inlet hole defined at the rear side. The gas introduced into the diffusing case may be discharged to an outside through a front side of the diffusing case. A light irradiator may be provided inside the diffusing case to irradiate light toward the front side of the diffusing case. A light diffusion frame may be provided in front of the light irradiator. The light irradiated from the light irradiator may be diffused while forwardly penetrating the light diffusion frame.

Embodiments disclosed herein may provide the diffuser and the hair dryer including the same capable of effectively irradiating the light to the user for the scalp and hair care. Embodiments disclosed herein may provide the diffuser and the hair dryer including the same with the scalp and hair care effects improved by irradiating the light that is uniformly dispersed and has the large area to the user. Embodiments disclosed herein may provide the diffuser and the hair dryer including the same in which the plurality of components are simply and effectively fastened and an efficient flow path of gas is included.

Embodiments disclosed herein may be implemented as a diffuser comprising a case having a front side and a rear side, the rear side configured to be removably coupled to a hair dryer, an inlet provided at the rear side of the case to receive fluid discharged from the hair dryer, a circuit board provided inside the case and having at least one light emitting device to irradiate light toward the front side of the case, and a light diffusion frame provided in front of the light emitting device and made of a light transmissive material, the light diffusion frame being configured to diffuse light transmitted through the light diffusion frame.

A light diffusion pattern configured to induce diffusion of the transmitted light may be formed on a front surface of the light diffusion frame. The light diffusion pattern may include at least one convex portion and at least one concave portion that may be alternately arranged with each other.

The at least one light emitting device may include a plurality of light emitting devices. The circuit board may include a plurality of boards. The light diffusion frame may have a cross-sectional shape corresponding to that of the circuit board.

The plurality of boards may include a central board provided at a center of the circuit board, a first board formed in a ring shape, the first board being radially spaced apart from the central board to define a first flow path and having the central board provided at a center of the first board, and a second board formed in a ring shape concentric with the first board, the second board being radially spaced apart from the first board.

The light diffusion frame may include a central light diffuser having a cross-sectional shape corresponding to that of the central board and provided at a front surface of the central board, a first light diffuser having a cross-sectional shape corresponding to that of the first board and provided at a front surface of the first board, and a second light diffuser having a cross-sectional shape corresponding to that of the second board provided on a front surface of the second board.

A first flow path may be defined between the central board and the first board and between the central light diffuser and the first light diffuser. A second flow path may be defined between the first board and the second board and between the first light diffuser and the second light diffuser. Fluid received through the inlet flows through the first and second flow paths toward the front side.

The first board may be positioned farther from the inlet in a front-rear direction than the central board, the second board may be positioned farther from the inlet in the front-rear direction than the first board, the first light diffuser may be positioned farther from the inlet in the front-rear direction than the central light diffuser, and the second light diffuser may be positioned farther from the inlet in the front-rear direction than the first light diffuser.

The light diffusion frame further may include at least one light diffusion rib extending along a radial direction of the light diffusion frame to connect the central light diffuser, the first light diffuser, and the second light diffuser to each other.

A guide frame may be provided inside the case to guide a flow of fluid introduced through the inlet. The guide frame may include a diffusion guide provided to face the inlet to diffuse the fluid introduced through the inlet, a first guide, and a second guide. The central board may be provided on a front surface of the diffusion guide. The first guide may be formed in a ring shape, the first guide being radially spaced apart from the diffusion guide to define a first flow path therebetween and having the diffusion guide provided at a center of the first guide. The second guide formed in a ring shape, the second guide being radially spaced apart from the first guide to define a second flow path therebetween and having the diffusion guide at a center of the second guide. The first board may be provided on a front surface of the first guide, and the second board may be provided on a front surface of the second guide.

The guide frame may include at least one guide rib extending along a radial direction of the guide frame to connect the diffusion guide, the first guide, and the second guide to each other. The at least one light diffusion rib may be provided in front of and coupled to the guide rib.

A proximity sensor may be provided on the central board to measure a distance to a target located in front of the case. The central light diffuser may include an opening aligning with the proximity sensor.

The proximity sensor may be configured to sense an infrared ray transmitted from the target to measure the distance to the target. The diffuser further may include a light blocking tube surrounding the proximity sensor to shield the proximity sensor from light emitted by the plurality of light emitting devices. The light blocking tube may have a front opening such that the infrared ray transmitted from the target may be provided to the proximity sensor. The light blocking tube may extend along a front-rear direction to penetrate the central light diffuser.

A cover may be provided on the front side of the case. The cover may include at least one discharge hole through which fluid inside of the case may be discharged. The cover may include an opening aligning with the proximity sensor so as to allow transmission of the infrared ray. The light blocking tube may extend rearward from a rear surface of the cover to surround the opening of the cover.

The cover may include a plurality of massage protrusions protruding forward. The plurality of the light emitters may be arranged to respectively align with the plurality of massage protrusions.

A hair dryer may comprise a main body including an outlet through which fluid may be discharged, a handle extending from the main body, and a diffuser. The diffuser may include a case having a front side and a rear side, the rear side configured to be removably coupled to the main body, an inlet provided at the rear side of the case to receive fluid discharged from the outlet, a circuit board provided inside the case, at least one light emitting device may be provided on the circuit board to irradiate light toward the front side of the case. A light diffuser may be provided in front of the at least one light emitting device and configured to diffuse light passing through the light diffuser.

The at least one light emitting device may include a plurality of light emitting devices. A center of the circuit board may be provided to be closer to the inlet than an outer edge of the circuit board such that light emitting devices provided at the outer edge of the circuit board may be farther from the inlet than light emitting devices provided at the center of the circuit board. The circuit board may include a plurality of openings through which fluid passes. A center of the light diffuser may be provided to be closer to the inlet than an outer edge of the circuit board. The light diffuser may include a plurality of openings that align with the plurality of openings of the circuit board so as not to obstruct a passage of fluid. The diffuser may be etched with a zig-zag or ridge pattern configured to diffuse light.

Embodiments disclosed herein may be implemented as a diffuser for a hair dryer comprising a case having an inlet configured to receive fluid, a circuit board provided inside of the case and aligning with the inlet in a first direction, the circuit board having a plurality of openings through which received fluid passes, a plurality of light emitting diodes provided on the circuit board, and a light diffusion frame provided to face a side of the circuit board having the light emitting diodes. The light diffusion frame may have a plurality of openings aligned with the plurality of openings of the circuit board so as not to interfere with a passage of fluid, a light diffusion pattern etched on a surface aligning with the circuit board in the first direction, the light diffusion pattern including at least one concave bend and at least one convex bend with respect to the first direction.

The light diffusion frame may include a plurality of concentric frames. An inner frame of the plurality of concentric frames, which may be provided at a center, may be provided to be closest to the inlet with respect to the first direction, and the rest of the plurality of concentric frames may be provided to be increasingly farther away in the first direction from the inlet. As a radius of the plurality of concentric frames increases, the concentric frames may be farther away from the inlet with respect to the first direction.

Although a specific embodiment of the present disclosure has been illustrated and described above, those of ordinary skill in the art to which the present disclosure pertains will appreciate that various modifications are possible within the limits without departing from the technical spirit of the present disclosure provided by the following claims.

In this specification, duplicate descriptions of the same components are omitted. It will be understood that when a component is referred to as being "connected with" another component, the component may be directly connected with the other component or intervening components may also be present. In contrast, it will be understood that when a component is referred to as being "directly connected with" another component in this specification, there are no intervening components present.

The terminology used herein is for the purpose of describing a specific embodiment only and is not intended to be limiting of the present disclosure. The singular forms "a" and "an" are intended to include the plural forms as well, unless the context clearly indicates otherwise.

It will be further understood that the terms "comprises", "comprising", "includes", and "including" specify the presence of the certain features, numbers, steps, operations, elements, and parts or combinations thereof, but do not preclude the presence or addition of one or more other features, numbers, steps, operations, elements, and parts or combinations thereof. The term 'and/or' includes a combination of a plurality of listed items or one of the plurality of listed items. In this specification, 'A or B' may include 'A', 'B', or 'both A and B'.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A diffuser comprising:

a case having a front side and a rear side, the rear side configured to be removably coupled to a hair dryer;

an inlet provided at the rear side of the case to receive fluid discharged from the hair dryer;

a circuit board provided inside the case and having at least one light emitting device to irradiate light toward the front side of the case; and a light diffusion frame provided in front of the light emitting device and made of a light transmissive material, the light diffusion frame being configured to diffuse light transmitted through the light diffusion frame.

2. The diffuser of claim 1, wherein a light diffusion pattern configured to induce diffusion of the transmitted light is formed on a front surface of the light diffusion frame, and the light diffusion pattern includes at least one convex portion and at least one concave portion that are alternately arranged with each other.

3. The diffuser of claim 1, wherein:

the at least one light emitting device includes a plurality of light emitting devices, the circuit board includes a plurality of boards, and the light diffusion frame has a cross-sectional shape corresponding to that of the circuit board.

4. The diffuser of claim 3, wherein the plurality of boards include:

a central board provided at a center of the circuit board, a first board formed in a ring shape, the first board being radially spaced apart from the central board to define a first flow path and having the central board provided at a center of the first board, and a second board formed in a ring shape concentric with the first board, the second board being radially spaced apart from the first board; and wherein the light diffusion frame includes:

a central light diffuser having a cross-sectional shape corresponding to that of the central board and provided at a front surface of the central board, a first light diffuser having a cross-sectional shape corresponding to that of the first board and provided at a front surface of the first board, and a second light diffuser having a cross-sectional shape corresponding to that of the second board provided on a front surface of the second board.

5. The diffuser of claim 4, wherein a first flow path is defined between the central board and the first board and between the central light diffuser and the first light diffuser, and a second flow path is defined between the first board and the second board and between the first light diffuser and the second light diffuser such that fluid received through the inlet flows through the first and second flow paths toward the front side.

6. The diffuser of claim 4, wherein:

the first board is positioned farther from the inlet in a front-rear direction than the central board, the second board is positioned farther from the inlet in the front-rear direction than the first board, the first light diffuser is positioned farther from the inlet in the front-rear direction than the central light diffuser, and the second light diffuser is positioned farther from the inlet in the front-rear direction than the first light diffuser.

7. The diffuser of claim 4, wherein the light diffusion frame further includes at least one light diffusion rib extending along a radial direction of the light diffusion frame to connect the central light diffuser, the first light diffuser, and the second light diffuser to each other.

8. The diffuser of claim 7, further comprising a guide frame provided inside the case to guide a flow of fluid introduced through the inlet, wherein the guide frame includes:

a diffusion guide provided to face the inlet to diffuse the fluid introduced through the inlet, wherein the central board is provided on a front surface of the diffusion guide;

a first guide formed in a ring shape, the first guide being radially spaced apart from the diffusion guide to define a first flow path therebetween and having the diffusion guide provided at a center of the first guide; and a second guide formed in a ring shape, the second guide being radially spaced apart from the first guide to define a second flow path therebetween and having the diffusion guide at a center of the second guide, wherein the first board is provided on a front surface of the first guide, and the second board is provided on a front surface of the second guide.

9. The diffuser of claim 8, wherein the guide frame further includes at least one guide rib extending along a radial direction of the guide frame to connect the diffusion guide, the first guide, and the second guide to each other, wherein the at least one light diffusion rib is provided in front of and coupled to the guide rib.

10. The diffuser of claim 4, further comprising a proximity sensor provided on the central board to measure a distance to a target located in front of the case, wherein the central light diffuser includes an opening aligning with the proximity sensor.

11. The diffuser of claim 10, wherein the proximity sensor is configured to sense an infrared ray transmitted from the target to measure the distance to the target, and the diffuser further includes a light blocking tube surrounding the proximity sensor to shield the proximity sensor from light emitted by the plurality of light emitting devices, wherein the light blocking tube has a front opening such that the infrared ray transmitted from the target is provided to the proximity sensor, and wherein the light blocking tube extends along a front-rear direction to penetrate the central light diffuser.

12. The diffuser of claim 11, further comprising a cover provided on the front side of the case, wherein the cover includes at least one discharge hole through which fluid inside of the case is discharged, and the cover includes an opening aligning with the proximity sensor so as to allow transmission of the infrared ray.

13. The diffuser of claim 12, wherein the light blocking tube extends rearward from a rear surface of the cover to surround the opening of the cover.

14. The diffuser of claim 12, wherein the cover includes a plurality of massage protrusions protruding forward, and the plurality of the light emitters are arranged to respectively align with the plurality of massage protrusions.

15. A hair dryer including the diffuser of claim 1.

16. A hair dryer, comprising:

a main body including an outlet through which fluid is discharged;

a handle extending from the main body; and a diffuser, including:

a case having a front side and a rear side, the rear side configured to be removably coupled to the main body;

an inlet provided at the rear side of the case to receive fluid discharged from the outlet;

a circuit board provided inside the case;

at least one light emitting device provided on the circuit board to irradiate light toward the front side of the case; and a light diffuser provided in front of the at least one light emitting device and configured to diffuse light passing through the light diffuser.

17. The hair dryer of claim 16, wherein:

the at least one light emitting device includes a plurality of light emitting devices;

a center of the circuit board is provided to be closer to the inlet than an outer edge of the circuit board such that light emitting devices provided at the outer edge of the circuit board are farther from the inlet than light emitting devices provided at the center of the circuit board;

the circuit board includes a plurality of openings through which fluid passes;

a center of the light diffuser is provided to be closer to the inlet than an outer edge of the circuit board; and the light diffuser includes a plurality of openings that align with the plurality of openings of the circuit board so as not to obstruct a passage of fluid.

18. The hair dryer of claim 16, wherein the diffuser is etched with a zig-zag pattern configured to diffuse light.

19. A diffuser for a hair dryer, comprising:

a case having an inlet configured to receive fluid;

a circuit board provided inside of the case and aligning with the inlet in a first direction, the circuit board having a plurality of openings through which received fluid passes;

a plurality of light emitting diodes provided on the circuit board; and a light diffusion frame provided to face a side of the circuit board having the light emitting diodes, the light diffusion frame having:

a plurality of openings aligned with the plurality of openings of the circuit board so as not to interfere with a passage of fluid, a light diffusion pattern etched on a surface aligning with the circuit board in the first direction, the light diffusion pattern including at least one concave bend and at least one convex bend with respect to the first direction.

20. The diffuser of claim 19, wherein the light diffusion frame includes a plurality of concentric frames, wherein an inner frame of the plurality of concentric frames, which is provided at a center, is provided to be closest to the inlet with respect to the first direction, and the rest of the plurality of concentric frames are provided to be increasingly farther away in the first direction from the inlet.

* * * * *